US011727878B2

(12) United States Patent
Son et al.

(10) Patent No.: US 11,727,878 B2
(45) Date of Patent: Aug. 15, 2023

(54) PIXEL CIRCUIT AND DISPLAY DEVICE INCLUDING THE SAME

(71) Applicant: LG Display Co., Ltd., Seoul (KR)

(72) Inventors: Ki Min Son, Paju-si (KR); Chang Hee Kim, Paju-si (KR); Ki Bok Park, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/893,987

(22) Filed: Aug. 23, 2022

(65) Prior Publication Data

US 2023/0073753 A1 Mar. 9, 2023

(30) Foreign Application Priority Data

Sep. 3, 2021 (KR) ..... 10-2021-0117543
Dec. 23, 2021 (KR) ..... 10-2021-0186071

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01);
(Continued)

(58) Field of Classification Search
CPC .. G09G 3/3233; G09G 3/3258; G09G 3/3266; G09G 3/3283; G09G 2230/00; G09G 2300/0426; G09G 2300/0469; G09G 2300/0819; G09G 2300/0842; G09G 2300/0852; G09G 2300/0861; G09G 2310/0216; G09G 2310/0297; G09G 2310/08; G09G 2320/0233;
(Continued)

(56) References Cited

U.S. PATENT DOCUMENTS

2021/0013235 A1* 1/2021 Toda ..... G02F 1/1368
2021/0065635 A1 3/2021 Choi et al.
2022/0366849 A1* 11/2022 Lee ..... G09G 3/3233

FOREIGN PATENT DOCUMENTS

KR 10-2020-0036415 A 4/2020
KR 10-2021-0014011 A 2/2021
KR 10-2021-0031582 A 3/2021

OTHER PUBLICATIONS

Great Britain Search Report for Britain Application No. GB2211741.0, dated Feb. 14, 2023.

* cited by examiner

*Primary Examiner* — Nelson M Rosario
(74) *Attorney, Agent, or Firm* — Birch, Stewart, Kolasch & Birch, LLP

(57) ABSTRACT

A pixel circuit and a display device including the pixel circuit are discussed. The pixel circuit can include a driving element including a first electrode connected to a first node to which a pixel driving voltage is applied, a gate electrode connected to a second node, and a second electrode connected to a third node; a first switch element including a first electrode connected to the third node, a gate electrode to which a first light emission control pulse is applied, and a second electrode connected to a fourth node; a second switch element including a first electrode connected to the third node, a gate electrode to which a second light emission control pulse is applied, and a second electrode connected to a fifth node; and a light emitting device including an anode connected to the fifth node, and a cathode electrode to which a low potential power voltage is applied.

17 Claims, 27 Drawing Sheets

(52) U.S. Cl.
CPC ..... *G09G 2300/0852* (2013.01); *G09G 2310/0262* (2013.01); *G09G 2310/08* (2013.01); *G09G 2320/0209* (2013.01); *G09G 2320/0233* (2013.01)

(58) Field of Classification Search
CPC ..... G09G 2320/0295; G09G 2320/045; G09G 3/3291; G09G 2310/0243; G09G 2320/0238; G09G 2330/028
See application file for complete search history.

PIXEL CIRCUIT AND DISPLAY DEVICE INCLUDING THE SAME

CROSS-REFERENCE TO RELATED APPLICATIONS

This application claims priority to and the benefit of Korean Patent Application No. 10-2021-0117543, filed Sep. 3, 2021 in the Republic of Korea, and Korean Patent Application No. 10-2021-0186071, filed Dec. 23, 2021 in the Republic of Korea, the entire contents of all these applications being hereby expressly incorporated by reference into the present application.

BACKGROUND

1. Field

The present disclosure relates to a pixel circuit and a display device including the same.

2. Discussion of Related Art

Electroluminescent display devices are roughly classified into inorganic light emitting display devices and organic light emitting display devices depending on the material of the emission layer. The organic light emitting display device of an active matrix type includes an organic light emitting diode (hereinafter, referred to as "OLED") that emits light by itself, and has an advantage in that the response speed is fast and the luminous efficiency, luminance, and viewing angle are large.

In the organic light emitting display device, the OLED is formed in each pixel. The organic light emitting display device not only has a fast response speed, excellent luminous efficiency, luminance, and viewing angle, but also has excellent contrast ratio and color reproducibility since it can express black gray scales in complete black.

A pixel circuit of the electroluminescent display device includes the OLED used as a light emitting element, and a driving element for driving the OLED.

An anode electrode of an OLED can be connected to a source electrode of a driving element, and a cathode electrode of the OLED can be connected to a low potential voltage source. The low potential voltage source can be commonly connected to pixels.

In this case, a gate-source voltage of the driving element can be changed upon a fluctuation of the low potential voltage source or under an influence of the OLED, which can cause deterioration of image quality. Because a current flowing through the OLED is determined depending on the gate-source voltage of the driving element, a change in the gate-source voltage of the driving element can cause a change in the luminance of the OLED. Due to a parasitic capacitance existing between the low potential voltage source, a ripple can be generated in the low potential voltage source when a change of the data voltage is large. As a result, a dark line or a bright line can be seen on a screen by inducing crosstalk between pixel lines whose data voltages change.

SUMMARY OF THE DISCLOSURE

The present disclosure is directed to solving or addressing the above-described needs and limitations associated with the related.

The present disclosure provides a pixel circuit and a display device including the same.

It should be noted that objects of the present disclosure are not limited to the above-described objects, and other objects of the present disclosure will be apparent to those skilled in the art from the following descriptions.

A pixel circuit according to an embodiment of the present disclosure can include a driving element including a first electrode connected to a first node to which a pixel driving voltage is applied, a gate electrode connected to a second node, and a second electrode connected to a third node; a first switch element including a first electrode connected to the third node, a gate electrode to which a first light emission control pulse is applied, and a second electrode connected to a fourth node; a second switch element including a first electrode connected to the third node, a gate electrode to which a second light emission control pulse is applied, and a second electrode connected to a fifth node; a light emitting device including an anode connected to the fifth node, and a cathode electrode to which a low potential power voltage is applied; a first capacitor connected between the second node and the fourth node; and a second capacitor connected between the first node and the third node.

According to the present disclosure, two switch elements are included between a driving element and a light emitting element, and the switch element connected to an anode electrode of the light emitting element is turned off in a sensing step. This can block the influence of a ripple of a low potential power voltage, thereby preventing the occurrence of horizontal crosstalk and thus preventing the deterioration of image quality associated with the occurrence of horizontal crosstalk.

According to the present disclosure, a compensation step is allocated between a data writing step and a boosting step, and a reference voltage is applied to a source node of a driving element during the compensation step. This can remove the influence of hysteresis of the driving element.

According to the present disclosure, an anode voltage relatively higher than a reference voltage is applied to a source node of a driving element before boosting. This can alleviate a change in luminance according to a data voltage.

The effects of the present disclosure are not limited to the above-mentioned effects, and other effects that are not mentioned will be apparently understood by those skilled in the art from the following description and the appended claims.

BRIEF DESCRIPTION OF THE DRAWINGS

The above and other objects, features, and advantages of the present disclosure will become more apparent to those of ordinary skill in the art by describing exemplary embodiments thereof in detail with reference to the attached drawings, in which.

DETAILED DESCRIPTION OF THE EMBODIMENTS

Figure 1:
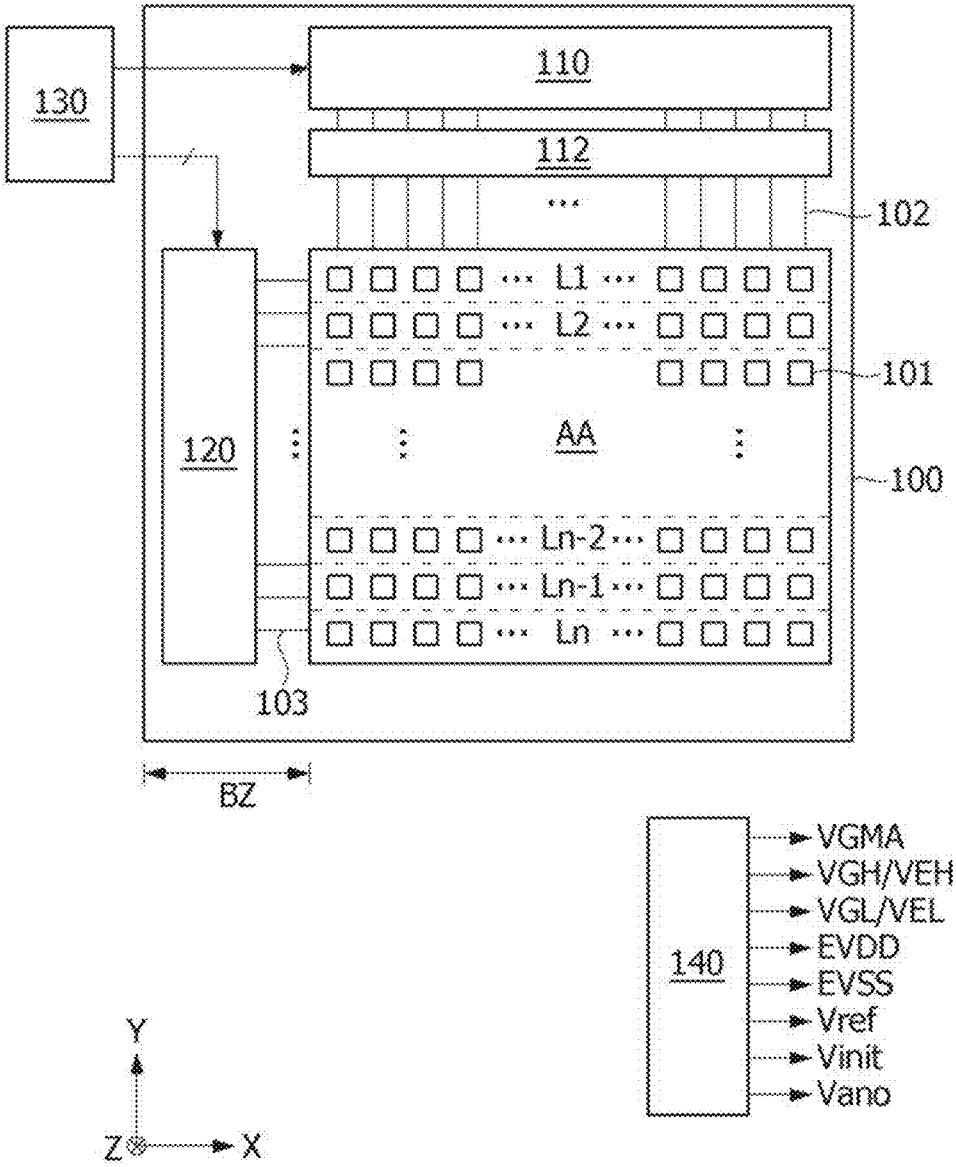
FIG. 1 is a block diagram illustrating a display device according to an embodiment of the present disclosure.

The advantages and features of the present disclosure and methods for accomplishing the same will be more clearly understood from embodiments described below with reference to the accompanying drawings. However, the present disclosure is not limited to the following embodiments but can be implemented in various different forms. Rather, the present embodiments will make the disclosure of the present disclosure complete and allow those skilled in the art to completely comprehend the scope of the present disclosure. The present disclosure is only defined within the scope of the accompanying claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies can be omitted to avoid unnecessarily obscuring the subject matter of the present disclosure.

The terms such as "comprising," "including," "having," and "consist of" used herein are generally intended to allow other components to be added unless the terms are used with the term "only." Any references to singular can include plural unless expressly stated otherwise.

Components are interpreted to include an ordinary error range even if not expressly stated.

When the position relation between two components is described using the terms such as "on," "above," "below," and "next," one or more components can be positioned between the two components unless the terms are used with the term "immediately" or "directly."

The terms "first," "second," and the like can be used to distinguish components from each other, but the functions or structures of the components are not limited by ordinal numbers or component names in front of the components.

The same reference numerals can refer to substantially the same elements throughout the present disclosure.

The following embodiments can be partially or entirely bonded to or combined with each other and can be linked and operated in technically various ways. The embodiments can be carried out independently of or in association with each other.

Hereinafter, various embodiments of the present disclosure will be described in detail with reference to the accompanying drawings.

According to one or more embodiments of the present disclosure, each of pixels is divided into a plurality of sub-pixels having different colors to implement color, and each of the sub-pixels includes a transistor used as a switch element or a driving element. Such a transistor can be implemented as a thin film transistor (TFT).

A driving circuit of a display device writes pixel data of an input image to pixels. A driving circuit of a flat panel display device includes a data driver for supplying a data signal to data lines, a gate driver for supplying a gate signal to gate lines, and the like.

In a display device of the present disclosure, a pixel circuit can include a plurality of transistors. The transistor can be implemented as a TFT having a metal-oxide-semiconductor FET (MOSFET) structure, and can be an oxide TFT including an oxide semiconductor or an LTPS TFT including a low temperature polysilicon (LTPS). Hereinafter, transistors constituting the pixel circuit will be described exemplarily using an example implemented with an n-channel oxide TFT, but the present disclosure is not limited thereto.

A transistor is a three-electrode device including a gate, a source, and a drain. The source is an electrode that supplies a carrier to the transistor. In the transistor, carriers begin to flow from the source. The drain is an electrode through which carriers exit the transistor. In the transistor, a carrier flows from the source to the drain. In case of an n-channel transistor, because the carrier is an electron, the source voltage is lower than the drain voltage so that electrons can flow from the source to the drain. In the n-channel transistor, the direction of current is from the drain to the source. In case of a p-channel transistor, because the carrier is a hole, the source voltage is higher than the drain voltage so that holes can flow from the source to the drain. In the p-channel transistor, current flows from the source to the drain because holes flow from the source to the drain. It should be noted that the source and the drain are not fixed in the transistor. For example, the source and the drain can be changed according to an applied voltage. Thus, the disclosure is not limited by the source and drain of the transistor. In the following description, the source and drain of the transistor will be referred to as first and second electrodes.

A gate signal can swing between a gate-on voltage and a gate-off voltage. The gate-on voltage is set to a voltage higher than the threshold voltage of the transistor. The gate-off voltage is set to a voltage lower than the threshold voltage of the transistor.

The transistor is turned on in response to the gate-on voltage and turned off in response to the gate-off voltage. In case of an n-channel transistor, the gate-on voltage can be a gate high voltage (VGH and VEH), and the gate-off voltage can be a gate low voltage (VGL and VEH).

Hereinafter, various embodiments of the present disclosure will be described in detail with reference to the accompanying drawings. In the following embodiments, the display device will be described focusing an organic light emitting display device, but the disclosure is not limited thereto. Further, all the components of each display device according to all embodiments of the present disclosure are operatively coupled and configured.

Figure 2:
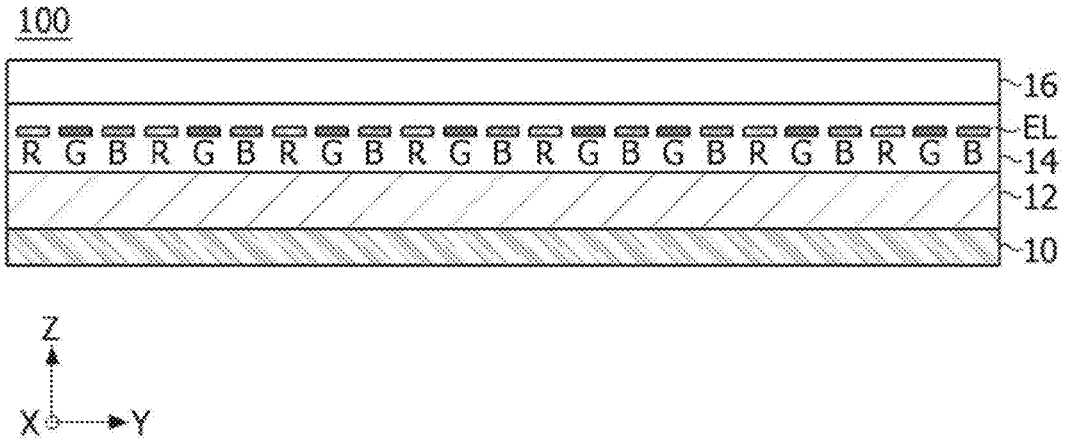
FIG. 2 is a diagram illustrating a cross-sectional structure of the display panel shown in FIG. 1.

FIG. 1 is a block diagram illustrating a display device according to an embodiment of the present disclosure, and FIG. 2 is a diagram illustrating a cross-sectional structure of the display panel shown in FIG. 1.

Referring to FIGS. 1 and 2, the display device according to an embodiment of the present disclosure includes a display panel 100, a display panel driver for writing pixel data to pixels P of the display panel 100, and a power supply 140 for generating power necessary for driving the pixels and the display panel driver.

The display panel 100 can be a display panel having a rectangular structure having a length in an X-axis direction, a width in a Y-axis direction, and a thickness in a Z-axis direction. The display panel 100 includes a pixel array AA that displays an input image. The pixel array AA includes a plurality of data lines 102, a plurality of gate lines 103 intersected with the data lines 102, and pixels arranged in a matrix form. The display panel 100 can further include power lines commonly connected to pixels. The power lines can include a power line to which a pixel driving voltage EVDD is applied, a power line to which an initialization voltage Vinit is applied, a power line to which a reference voltage Vref is applied, and a power line to which a low potential power voltage EVSS is applied. These power lines are commonly connected to the pixels.

The pixel array AA includes a plurality of pixel lines L1 to Ln, where n can be a positive number such as an integer greater than 1. Each of the pixel lines L1 to Ln includes one line of pixels arranged along a line direction X in the pixel array AA of the display panel 100. Pixels arranged in one pixel line share the gate lines 103. Sub-pixels arranged in a column direction Y along a data line direction share the same data line 102. One horizontal period 1H is a time obtained by dividing one frame period by the total number of pixel lines L1 to Ln.

The display panel 100 can be implemented as a non-transmissive display panel or a transmissive display panel. The transmissive display panel can be applied to a transparent display device in which an image is displayed on a screen and an actual background can be seen.

The display panel 100 can be implemented as a flexible display panel. The flexible display panel can be made of a plastic OLED panel. An organic thin film can be disposed on a back plate of the plastic OLED panel, and the pixel array AA and light emitting element can be formed on the organic thin film.

To implement color, each of the pixels 101 can be divided into a red sub-pixel (hereinafter referred to as "R sub-pixel"), a green sub-pixel (hereinafter referred to as "G sub-pixel"), and a blue sub-pixel (hereinafter referred to as "B sub-pixel"). Each of the pixels can further include a white sub-pixel. Each of the sub-pixels includes a pixel circuit. The pixel circuit is connected to the data line, the gate line and power line.

The pixels can be arranged as real color pixels and pentile pixels. The pentile pixel can realize a higher resolution than the real color pixel by driving two sub-pixels having different colors as one pixel 101 using a preset pixel rendering algorithm. The pixel rendering algorithm can compensate for insufficient color representation in each pixel with a color of light emitted from an adjacent pixel.

Touch sensors can be disposed on the display panel 100. A touch input can be sensed using separate touch sensors or can be sensed through pixels. The touch sensors can be disposed as an on-cell type or an add-on type on the screen of the display panel or implemented as in-cell type touch sensors embedded in the pixel array AA.

Touch sensors can be disposed on the display panel 100. A touch input can be sensed using separate touch sensors or can be sensed through pixels. The touch sensors can be disposed as an on-cell type or an add-on type on the screen of the display panel or implemented as in-cell type touch sensors embedded in the pixel array AA.

The circuit layer 12 can include a pixel circuit connected to wirings such as a data line, a gate line, and a power line, a gate driver (GIP) connected to the gate lines, and the like. The wirings and circuit elements of the circuit layer 12 can include a plurality of insulating layers, two or more metal layers separated with the insulating layer therebetween, and an active layer including a semiconductor material.

The light emitting element layer 14 can include a light emitting element EL driven by a pixel circuit. The light emitting element EL can include a red (R) light emitting element, a green (G) light emitting element, and a blue (B) light emitting element. The light emitting element layer 14 can include a white light emitting element and a color filter. The light emitting elements EL of the light emitting element layer 14 can be covered by a protective layer including an organic film and a passivation film.

The encapsulation layer 16 covers the light emitting element layer 14 to seal the circuit layer 12 and the light emitting element layer 14. The encapsulation layer 16 can have a multilayered insulating structure in which an organic film and an inorganic film are alternately stacked. The inorganic film blocks the penetration of moisture and oxygen. The organic film planarizes the surface of the inorganic film. When the organic film and the inorganic film are stacked in multiple layers, a movement path of moisture or oxygen becomes longer compared to a single layer, so that penetration of moisture and oxygen affecting the light emitting element layer 14 can be effectively blocked.

A touch sensor layer can be disposed on the encapsulation layer 16. The touch sensor layer can include capacitive type touch sensors that sense a touch input based on a change in capacitance before and after the touch input. The touch sensor layer can include metal wiring patterns and insulating layers forming the capacitance of the touch sensors. The capacitance of the touch sensor can be formed between the metal wiring patterns. A polarizing plate can be disposed on the touch sensor layer. The polarizing plate can improve visibility and contrast ratio by converting the polarization of external light reflected by metal of the touch sensor layer and the circuit layer 12. The polarizing plate can be implemented as a polarizing plate in which a linear polarizing plate and a phase delay film are bonded, or a circular polarizing plate. A cover glass can be adhered to the polarizing plate.

The display panel 100 can further include a touch sensor layer and a color filter layer stacked on the encapsulation layer 16. The color filter layer can include red, green, and blue color filters and a black matrix pattern. The color filter layer can replace the polarizing plate and increase the color purity by absorbing a part of the wavelength of light reflected from the circuit layer and the touch sensor layer. In this embodiment, by applying the color filter layer 20 having a higher light transmittance than the polarizing plate to the display panel, the light transmittance of the display panel PNL can be improved, and the thickness and flexibility of the display panel PNL can be improved. A cover glass can be adhered on the color filter layer.

The power supply 140 generates DC power required for driving the pixel array AA and the display panel driver of the display panel 100 by using a DC-DC converter. The DC-DC converter can include a charge pump, a regulator, a buck converter, a boost converter, and the like. The power supply 140 can adjust a DC input voltage from a host system and thereby generate DC voltages such as a gamma reference voltage VGMA, gate-on voltages VGH and VEH, gate-off voltages VGL and VEL, a pixel driving voltage EVDD, a low-potential power supply voltage ELVSS, a reference voltage Vref, an initialization voltage Vinit, an anode voltage Vano, and the like. The gamma reference voltage VGMA is supplied to a data driver 110. The gate-on voltages VGH and VEH and the gate-off voltages VGL and VEL are supplied to a gate driver 120. The pixel driving voltage EVDD and the low-potential power supply voltage ELVSS, a reference voltage Vref, an initialization voltage Vinit, an anode voltage Vano, and the like are commonly supplied to the pixels.

The display panel driver writes pixel data (digital data) of an input image to the pixels of the display panel 100 under the control of a timing controller (TCON) 130.

The display panel driver includes the data driver 110 and the gate driver 120. A display panel driver can further include a demultiplexer array 112 disposed between data lines 102 and a data driver 110.

The demultiplexer array 112 sequentially supplies data voltages output from channels of the data driver 110 to the data lines 102 using a plurality of demultiplexers (DEMUXs). The demultiplexers can include a plurality of switch elements disposed on the display panel 100. When the demultiplexers are disposed between output terminals of the data driver 110 and the data lines 102, the number of channels of the data driver 110 can be reduced. The demultiplexer array 112 can be omitted.

The display panel driver can further include a touch sensor driver for driving the touch sensors. The touch sensor driver is omitted from FIG. 1. The touch sensor driver can be integrated into one drive integrated circuit (IC). In a mobile device or wearable device, the timing controller 130, the power supply 140, the data driver 110, the touch sensor driver, and the like can be integrated into one drive integrated circuit (IC).

A display panel driver can operate in a low-speed driving mode under the control of a timing controller (TCON) 130. The low-speed driving mode can be set to reduce power consumption of a display device when there is no change in an input image for a preset number of frames in analysis of the input image. In the low-speed driving mode, the power consumption of the display panel driver and a display panel 100 can be reduced by lowering a refresh rate of pixels when a still image is input for a predetermined time or longer. A low-speed driving mode is not limited to a case in which a still image is input. For example, when the display device operates in a standby mode or when a user command or an input image is not input to a display panel driver for a predetermined time or more, the display panel driver can operate in the low-speed driving mode.

The data driver 110 generates a data voltage Vdata by converting pixel data of an input image received from the timing controller 130 with a gamma compensation voltage every frame period by using a digital to analog converter (DAC). The gamma reference voltage VGMA is divided for respective gray scales through a voltage divider circuit. The gamma compensation voltage divided from the gamma reference voltage VGMA is provided to the DAC of the data driver 110. The data voltage Vdata is outputted through the output buffer AMP in each of the channels of the data driver 110.

The gate driver 120 can be implemented as a gate in panel (GIP) circuit formed directly on a circuit layer 12 of the display panel 100 together with the TFT array of the pixel array AA. The gate in panel (GIP) circuit can be disposed on a bezel area BZ that is a non-display area of the display panel 100 or dispersed in the pixel array on which an input image is reproduced. The gate driver 120 sequentially outputs gate signals to the gate lines 103 under the control of the timing controller 130. The gate driver 120 can sequentially supply the gate signals to the gate lines 103 by shifting the gate signals using a shift register. The gate signal can include scan pulses, emission control pulses (hereinafter referred to as "EM pulses"), initialization pulses, and sensing pulses.

The shift register of the gate driver 120 outputs a pulse of the gate signal in response to a start pulse and a shift clock from the timing controller 130, and shifts the pulse according to the shift clock timing.

The timing controller 130 receives, from a host system, digital video data DATA of an input image and a timing signal synchronized therewith. The timing signal includes a vertical synchronization signal Vsync, a horizontal synchronization signal Hsync, a main clock CLK, a data enable signal DE, and the like. Because a vertical period and a horizontal period can be known by counting the data enable signal DE, the vertical synchronization signal Vsync and the horizontal synchronization signal Hsync can be omitted. The data enable signal DE has a cycle of one horizontal period (1H).

A host system can be any one of a television (TV) system, a tablet computer, notebook computer, a navigation system, a personal computer (PC), a home theater system, a mobile device, and a vehicle system. The host system can scale an image signal from a video source according to the resolution of the display panel 100 and transmit the image signal to a timing controller 130 together with the timing signal.

The timing controller 130 multiplies an input frame frequency by i and controls the operation timing of the display panel driver with a frame frequency of the input frame frequency×i (i is a positive integer greater than 0) Hz. The input frame frequency is 60 Hz in the NTSC (National Television Standards Committee) scheme and 50 Hz in the PAL (Phase-Alternating Line) scheme. The timing controller 130 can lower a driving frequency of the display panel driver by lowering a frame frequency to a frequency between 1 Hz and 30 Hz to lower a refresh rate of pixels in the low-speed driving mode.

Based on the timing signals Vsync, Hsync, and DE received from the host system, the timing controller 130 generates a data timing control signal for controlling the operation timing of the data driver 110, a control signal for controlling the operation timing of the de-multiplexer array 112, and a gate timing control signal for controlling the operation timing of the gate driver 120. The timing controller 130 controls an operation timing of the display panel driver to synchronize the data driver 110, the demultiplexer array 112, a touch sensor driver, and a gate driver 120.

The voltage level of the gate timing control signal outputted from the timing controller 130 can be converted into the gate-on voltages VGH and VEH and the gate-off voltages VGL and VEL through a level shifter and then supplied to the gate driver 120. For example, the level shifter converts a low level voltage of the gate timing control signal into the gate-off voltages VGL and VEL and converts a high level voltage of the gate timing control signal into the gate-on voltages VGH and VEH. The gate timing signal includes the start pulse and the shift clock.

Due to process variations and device characteristic variations caused in a manufacturing process of the display panel 100, there can be a difference in electrical characteristics of the driving element between the pixels, and this difference can increase as a driving time of the pixels elapses. An internal compensation technology or an external compensation technology can be applied to an organic light-emitting diode display to compensate for the variations in electrical characteristics of a driving element between the pixels. The internal compensation technology samples a threshold voltage of the driving element for each sub-pixel using an internal compensation circuit implemented in each pixel circuit to compensate a gate-source voltage Vgs of the driving element as much as the threshold voltage. The external compensation technology senses in real time a current or voltage of the driving element which changes according to the electrical characteristics of the driving element using an external compensation circuit. The external compensation technology compensates the variation (or change) in the electrical characteristics of the driving element in each pixel in real time by modulating the pixel data (digital data) of the input image as much as the electric characteristic variation (or change) of the driving element sensed for each pixel. The display panel driver can drive the pixels using the external compensation technology and/or the internal compensation technology. A pixel circuit of the present disclosure can be implemented as a pixel circuit to which an internal compensation circuit is applied.

Figure 3:
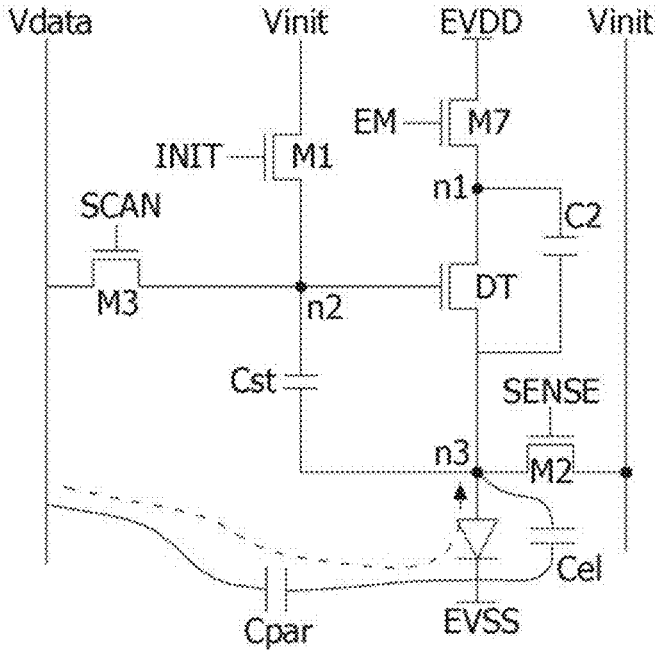
FIG. 3 is a circuit diagram illustrating an example of a pixel circuit according to a comparative example in which a gate-source voltage Vgs of a driving element DT is affected by a ripple of a low potential power voltage EVSS.
Figure 4:
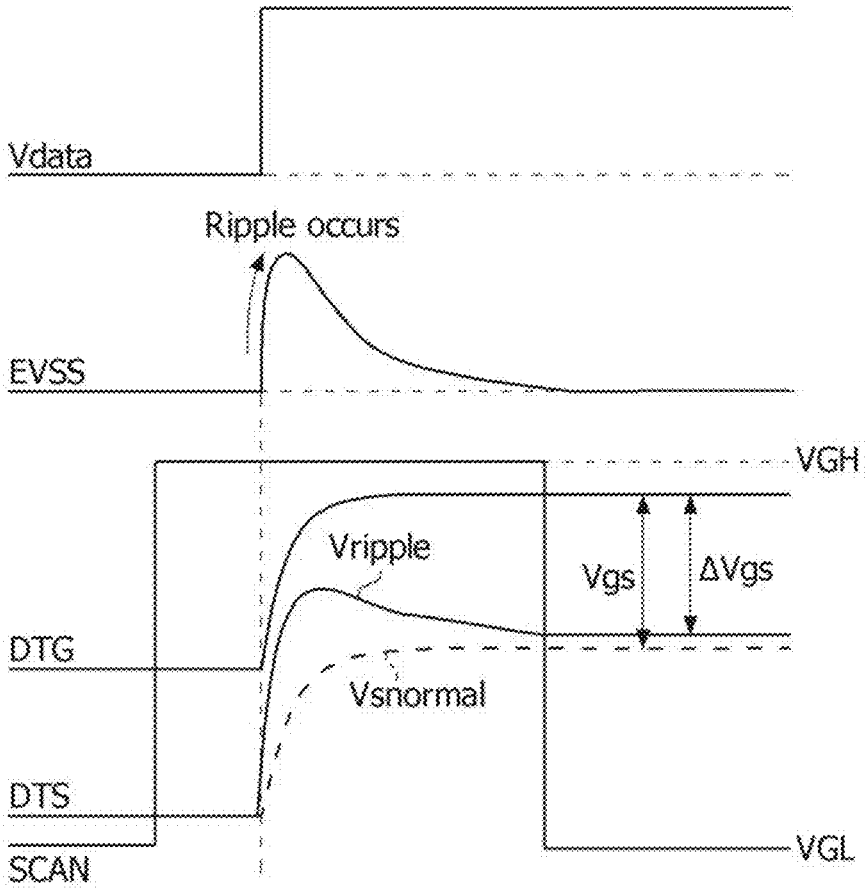
FIG. 4 is a waveform diagram illustrating an example in which the gate-source voltage Vgs of the driving element DT is changed when the ripple occurs in the low potential power voltage EVSS.
Figure 5A:
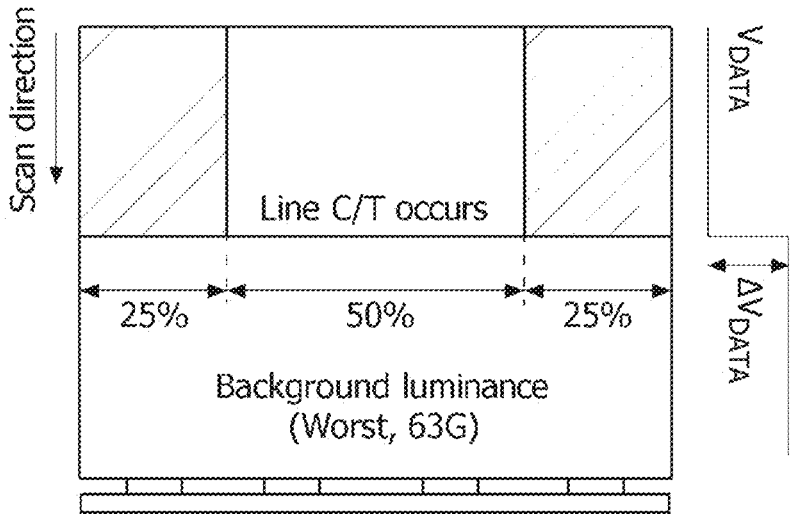
FIGS. 5A and 5B are diagrams illustrating a case in which image quality is deteriorated due to the ripple of the low potential power supply voltage.
Figure 5B:
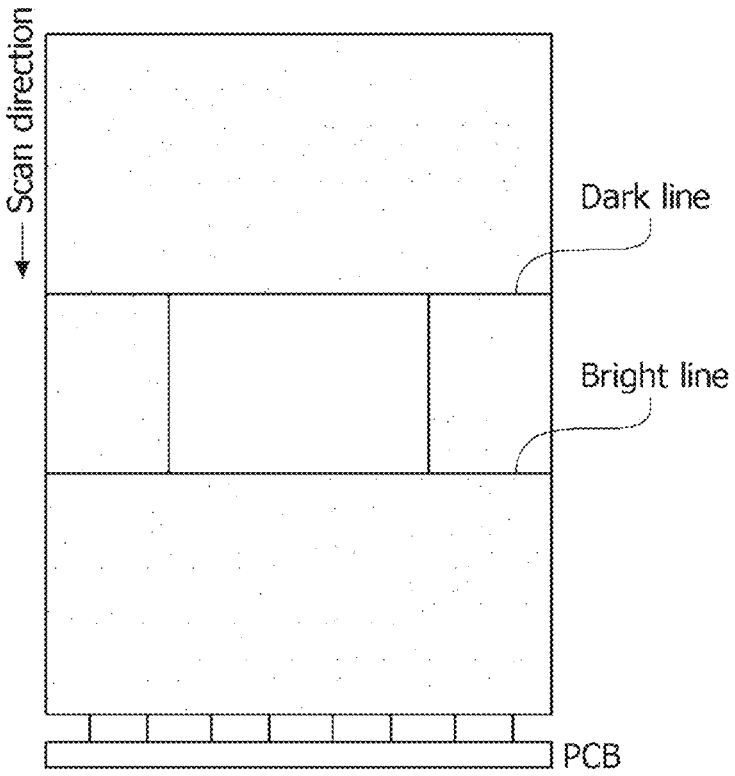

FIG. 3 is a circuit diagram illustrating an example of a pixel circuit according to a comparative example in which a gate-source voltage Vgs of a driving element DT is affected by a ripple of a low potential power voltage EVSS. FIG. 4 is a waveform diagram illustrating an example in which the gate-source voltage Vgs of the driving element DT is changed when the ripple occurs in the low potential power voltage EVSS, and FIGS. 5A and 5B are diagrams illustrating a case in which image quality is deteriorated due to the ripple of the low potential power supply voltage.

Referring to FIGS. 3 and 4, the pixel circuit according to the comparative example includes a light emitting element EL, a driving element DT, a plurality of switch elements M1, M2, M3, and M7, and capacitors Cst and C2.

In the pixel circuit of the comparative example, the light emitting element EL can further include a capacitor Cel formed between an anode electrode and a cathode electrode. In pixels, power lines or electrodes to which a low potential power voltage EVSS is applied are commonly connected. The driving element DT includes a first electrode connected to a first node n1, a gate electrode connected to a second node n2, and a second electrode connected to a third node n3. The first node n1 is connected to a first power line to which a pixel driving voltage EVDD is applied via a switch element M7. The light emitting element EL includes the anode electrode connected to a third node n3, and the cathode electrode connected to a second power line PL2 to which the low potential power voltage EVSS is applied. The driving element DT generates a current for driving the light emitting element EL according to a gate-source voltage Vgs.

The third switch element M3 includes a first electrode to which a data voltage Vdata of pixel data is applied, a gate electrode to which a scan pulse SCAN is applied, and a second electrode connected to the second node n2. The third switch element M3 is turned on according to a gate-on voltage VGH of the scan pulse SCAN and supplies the data voltage Vdata to the second node n2. The capacitor Cst stores the gate-source voltage Vgs of the driving element DT.

The anode electrode of the light emitting element EL is connected to the second electrode of the driving element DT, and a parasitic capacity Cpar can exist between a data line DL and a second power line PL2. In this pixel circuit of the comparative example, when the amount of change of the data voltage Vdata is relatively large, a ripple occurs in the low potential power voltage EVSS applied to the second power line PL2 through the parasitic capacitance Cpar. The low potential power voltage EVSS is delivered to the source node of the driving element, for example, the third node n3, through the capacitor Cel of the light emitting element EL. In this case, a voltage of the third node n3 or a source voltage DTS is changed by the ripple of the low potential power voltage EVSS, which causes a deviation of the gate-source voltage Vgs, and changes the luminance of the light emitting element EL.

In FIG. 4, 'DTG' is the gate voltage of the driving element DT, and 'DTS' is the source voltage of the driving element DT. Here, 'Vripple' is the source voltage DTS that is changed under the influence of the ripple of the low potential power voltage EVSS. Further, 'ΔVgs' is the gate-source voltage of the driving element DT that is changed under the influence of the low potential power voltage EVSS. Also, 'Vsnormal' denotes an ideal source voltage DTS in case of no ripple of the low potential power voltage EVSS or being not affected by the ripple of the low potential power voltage EVSS. Further, 'Vgs' is the gate-source voltage of the driving element DT when there is no ripple of the low potential power voltage EVSS.

As shown in FIG. 5A, the ripple of the low potential power voltage EVSS causes horizontal crosstalk, and as shown in FIG. 5B, image quality defects such as dark lines or bright lines occur on a screen.

Embodiments intend to block the influence of the low potential power voltage EVSS and the light emitting element EL on the gate-source voltage Vgs of the driving element DT in each of sub-pixels by adding a switch element between the light emitting element EL and the source node of the driving element.

Figure 6:
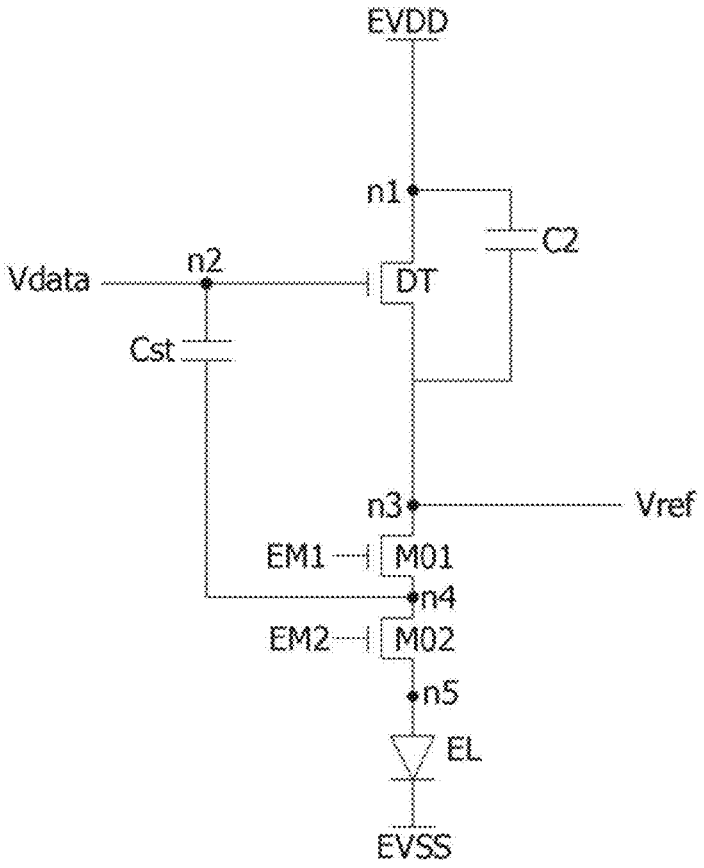
FIG. 6 is a circuit diagram illustrating a pixel circuit according to a first embodiment of the present disclosure.

FIG. 6 is a circuit diagram illustrating a pixel circuit according to a first embodiment of the present disclosure.

Referring to FIG. 6, the pixel circuit according to the first embodiment of the present disclosure can include a light emitting element EL, a driving element DT for driving the light emitting element EL, a plurality of switch elements M01 and M02, a first capacitor Cst, and a second capacitor C2.

The light-emitting element EL can be implemented as an OLED. The OLED includes an organic compound layer formed between an anode and a cathode. The organic compound layer can include a hole injection layer (HIL), a hole transport layer (HTL), a light-emitting layer (EML), an electron transport layer (ETL), an electron injection layer (EIL), and the like, but is not limited thereto. An anode electrode of the light emitting element EL is connected to a fifth node n5, and a cathode electrode is connected to a third power line PL3 to which a low potential power voltage EVSS is applied. When a voltage is applied to the anode and cathode electrodes of the light emitting element EL, holes passing through a hole transport layer HTL and electrons passing through an electron transport layer ETL are moved to an emission layer EML and form exciton, which thereby emits visible light in the emission layer EML.

An organic light emitting diode used as the light emitting element can have a tandem structure in which a plurality of light emitting layers are stacked. The organic light emitting diode having the tandem structure can improve the luminance and lifespan of the pixel.

The driving element DT generates a current according to a gate-source voltage Vgs and drives the light emitting element EL. The driving element DT includes a first electrode connected to a first node n1, a gate electrode connected to a second node n2, and a second electrode connected to a third node n3.

The first switch element M01 is turned on according to a gate-on voltage VEH of a first light emission control pulse EM1 and connects the third node n3 to a fourth node n4. The first switch element M1 includes a first electrode connected to the third node n3, a gate electrode to which the first light emission control pulse EM1 is applied, and a second electrode connected to the fourth node n4.

The second switch element M02 is turned on according to a gate-on voltage VEH of a second light emission control pulse EM2 and connects the fourth node n4 to a fifth node n5. The second switch element M2 includes a first electrode connected to the fourth node n4, a gate electrode to which the second light emission control pulse EM2 is applied, and a second electrode connected to the fifth node n5.

The first capacitor Cst is connected between the second node n2 and the fourth node n4. The second capacitor C2 is connected between the first node n1 and the third node n3.

Figure 7:
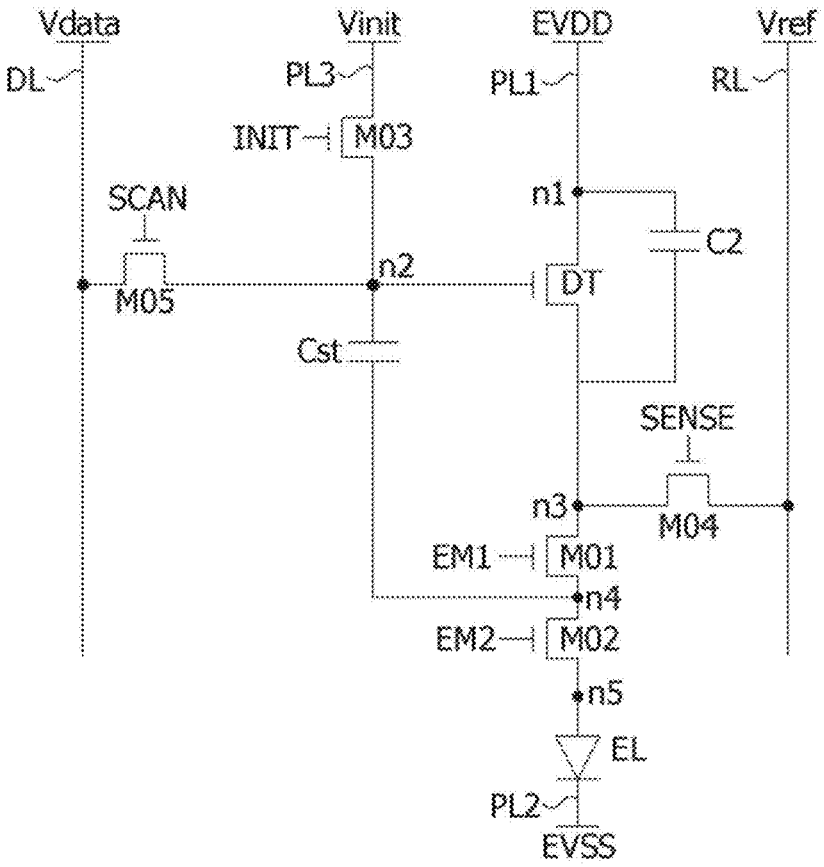
FIG. 7 is a circuit diagram illustrating a pixel circuit according to a second embodiment of the present disclosure.
Figure 8A:
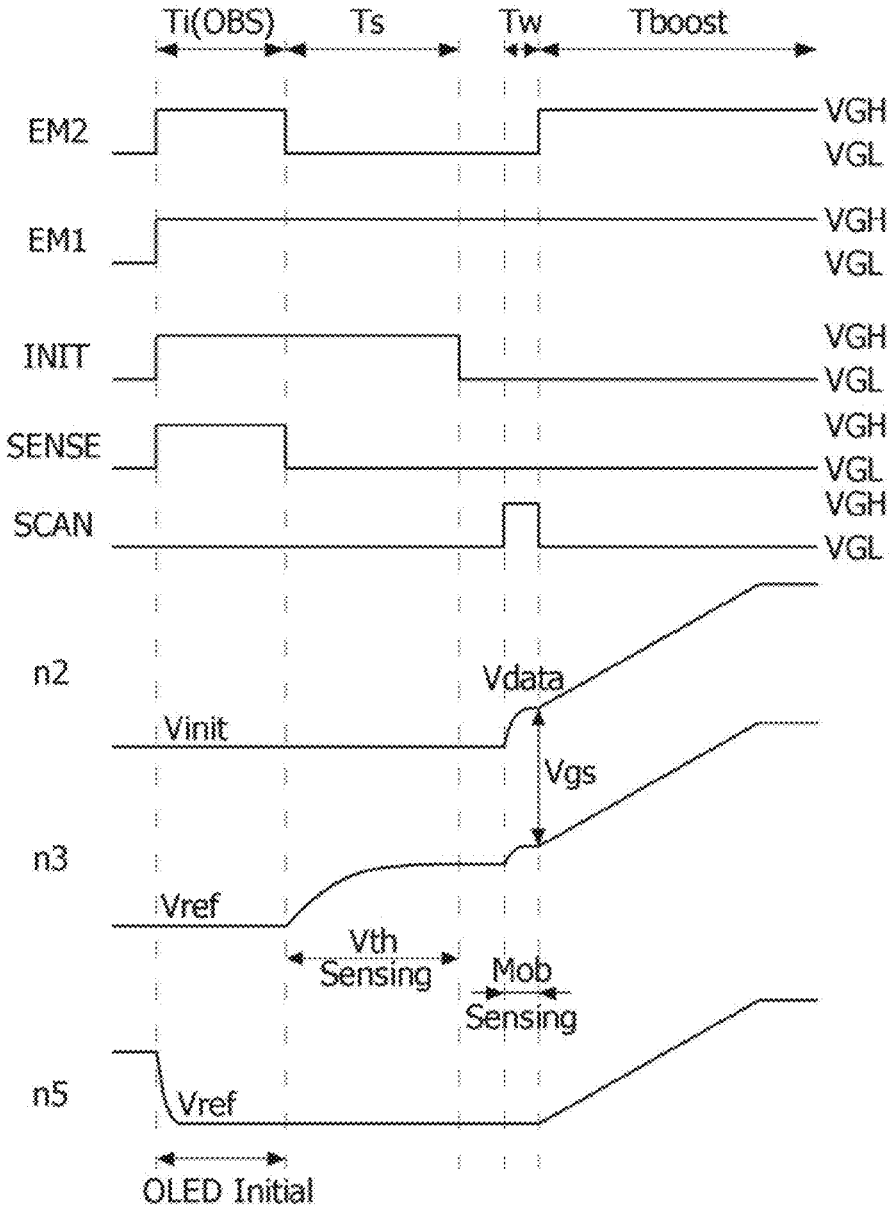
FIGS. 8A and 8B are waveform diagrams illustrating a gate signal applied to the pixel circuit shown in FIG. 7.
Figure 8B:
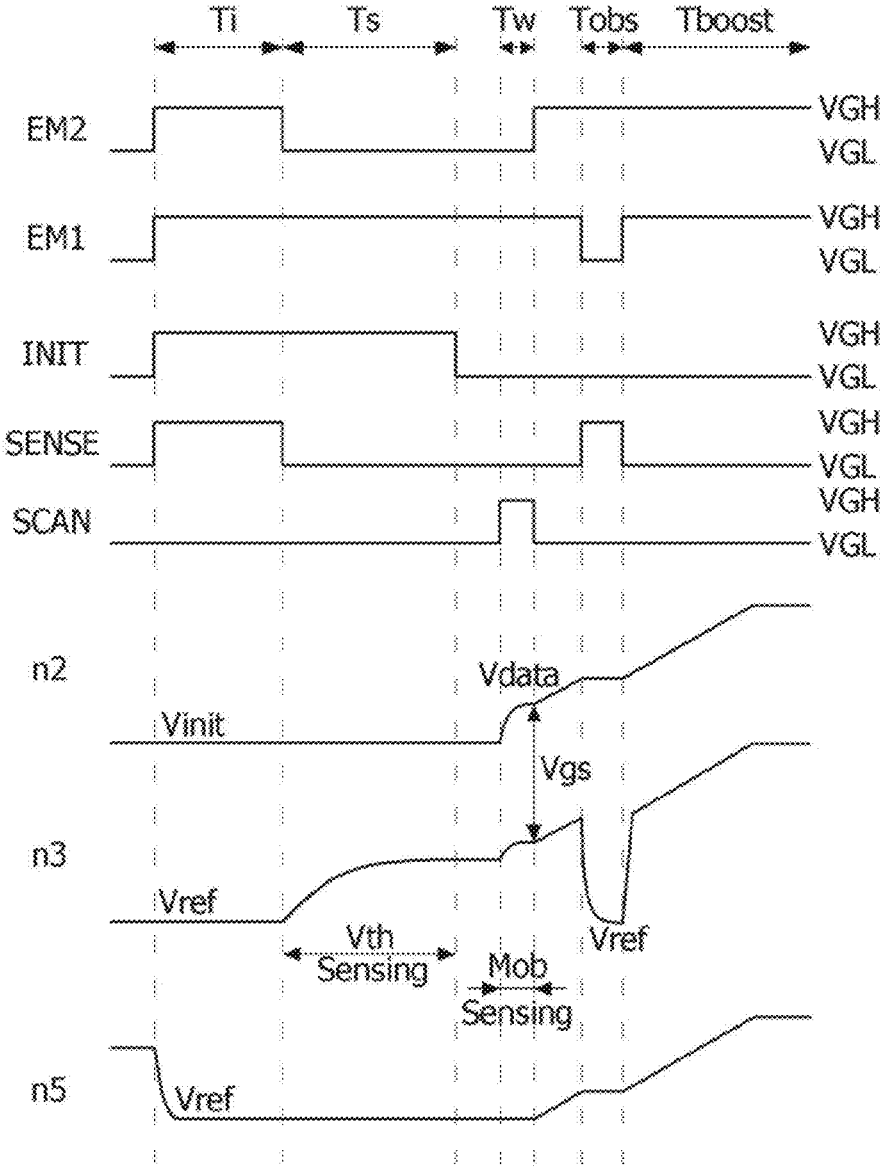

FIG. 7 is a circuit diagram illustrating a pixel circuit according to a second embodiment of the present disclosure, and FIGS. 8A and 8B are waveform diagrams illustrating a gate signal applied to the pixel circuit shown in FIG. 7.

Referring to FIGS. 7 and 8, the pixel circuit according to the second embodiment of the present disclosure includes a light emitting element EL, a driving element DT for driving the light emitting element EL, a plurality of switch elements M01, M02, M03, M04, and M05, a first capacitor Cst, and a second capacitor C2. The driving element DT and the switch elements M01, M02, M03, M04, and M05 can be implemented as n-channel oxide TFTs.

This pixel circuit is connected to a first power line PL1 to which a pixel driving voltage EVDD is applied, a second power line PL2 to which a low potential power voltage EVSS is applied, a third power line PL3 to which an initialization voltage Vinit is applied, a fourth power line RL to which a reference voltage Vref is applied, a data line DL to which a data voltage Vdata is applied, and gate lines to which gate signals INIT, SENSE, SCAN, EM1, and EM2 are applied.

The driving element DT generates a current according to a gate-source voltage Vgs and drives the light emitting element EL. The driving element DT includes a first electrode connected to a first node n1, a gate electrode connected to a second node n2, and a second electrode connected to a third node n3.

The first switch element M01 is turned on according to a gate-on voltage VEH of a first light emission control pulse EM1 and connects the third node n3 to a fourth node n4. The first switch element M01 includes a first electrode connected to the third node n3, a gate electrode to which the first light emission control pulse EM1 is applied, and a second electrode connected to the fourth node n4.

The second switch element M02 is turned on according to a gate-on voltage VEH of a second light emission control pulse EM2 and connects the fourth node n4 to a fifth node n5. The second switch element M02 includes a first electrode connected to the fourth node n4, a gate electrode to which the second light emission control pulse EM2 is applied, and a second electrode connected to the fifth node n5.

The third switch element M03 is turned on according to a gate-on voltage VGH of an initialization pulse INIT and applies the initialization voltage Vinit to the second node n2. The third switch element M03 includes a first electrode connected to the third power line PL3 to which the initialization voltage Vinit is applied, a gate electrode to which the initialization pulse INIT is applied, and a second electrode connected to the second node n2.

The fourth switch element M04 is turned on according to a gate-on voltage VGH of a sensing pulse SENSE and supplies the reference voltage Vref to the third node n3. The fourth switch element M04 includes a first electrode connected to the third node n3, a gate electrode to which the sensing pulse SENSE is applied, and a second electrode connected to the fourth power line RL.

The fifth switch element M05 is turned on according to a gate-on voltage VGH of a scan pulse SCAN and connects the data line DL to the second node n2. The fifth switch element M05 includes a first electrode connected to the data line DL to which the data voltage Vdata is applied, a gate electrode to which the scan pulse SCAN is applied, and a second electrode connected to the second node n2.

The first capacitor Cst is connected between the second node n2 and the fourth node n4. The second capacitor C2 is connected between the first node n1 and the third node n3.

The pixel circuit can be driven in the order of an initialization step Ti, a sensing step Ts, a data writing step Tw, and a boosting step Tboost as shown in FIG. 8A. Alternatively, a compensation step Tobs is added as shown in FIG. 8B, and the pixel circuit can be driven in the order of the initialization step Ti, the sensing step Ts, the data writing step Tw, the compensation step Tobs, and the boosting step Tboost. In the compensation step, the source and gate voltages of the driving element DT are controlled to be in a constant on-state in order to minimize a compensation error due to the Vth hysteresis of the driving element DT.

FIGS. 9A to 9E are circuit diagrams illustrating the operation of the pixel circuit shown in FIG. 7 in stages. Here, the operation according to the driving timing as shown in FIG. 8B will be described.

Figure 9A:
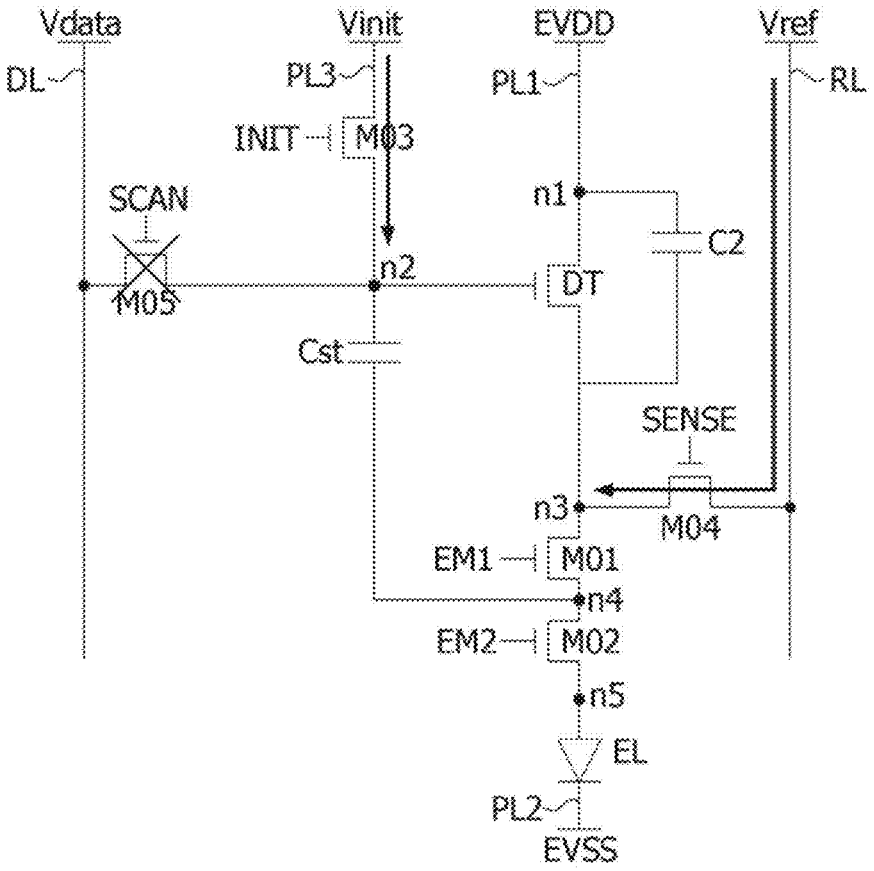
FIGS. 9A to 9E are circuit diagrams illustrating the operation of the pixel circuit shown in FIG. 7 in stages.

As shown in FIG. 9A, in the initialization step Ti, the first, second, third, and fourth switch elements M01, M02, M03, and M04 are turned on, and the fifth switch element M05 is turned off. The initialization voltage Vinit is applied to the second node n2, and the reference voltage Vref is applied to the third node n3. At this time, the driving element DT is turned on, and the light emitting element EL is not turned on.

Figure 9B:
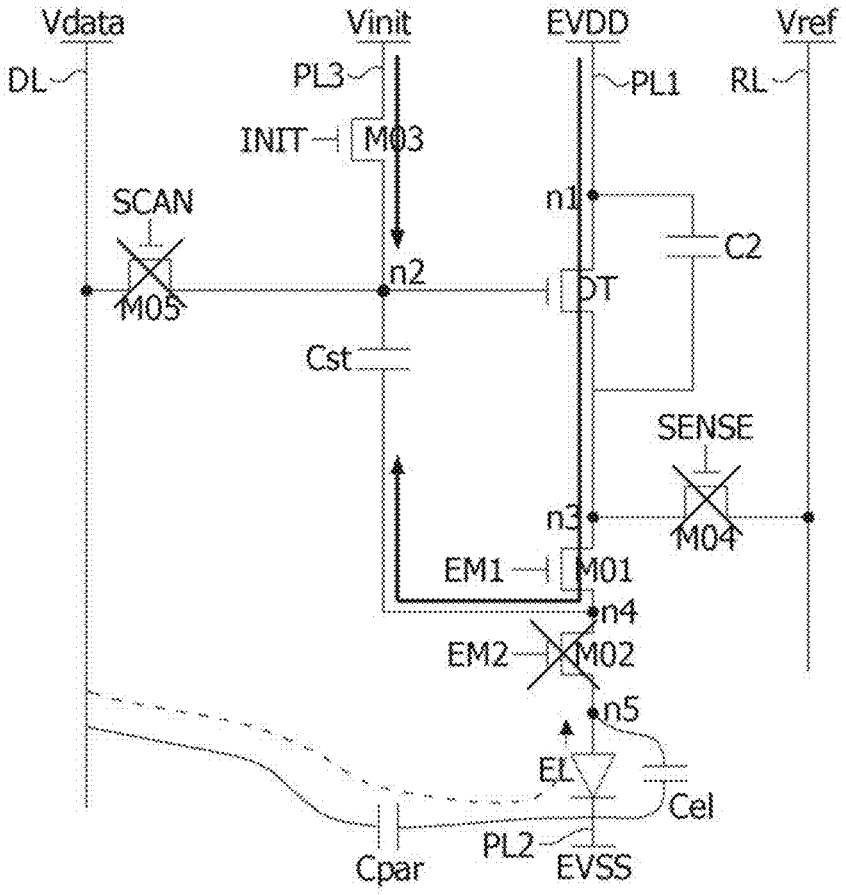

As shown in FIG. 9B, in the sensing step Ts, the first switch element M01 maintains the turned-on state and thus the voltage of the third node n3 increases. When the gate-source voltage Vgs of the driving element DT reaches the threshold voltage Vth, the driving element DT is turned off and the threshold voltage Vth is stored in the first capacitor Cst. Because the second switch element M02 is turned off in the sensing step Ts, even if a ripple of the low potential power voltage occurs, it is blocked by the second switch element M02 and thus the third node n3 is not affected by the low potential power voltage EVSS and the light emitting element EL.

Figure 9C:
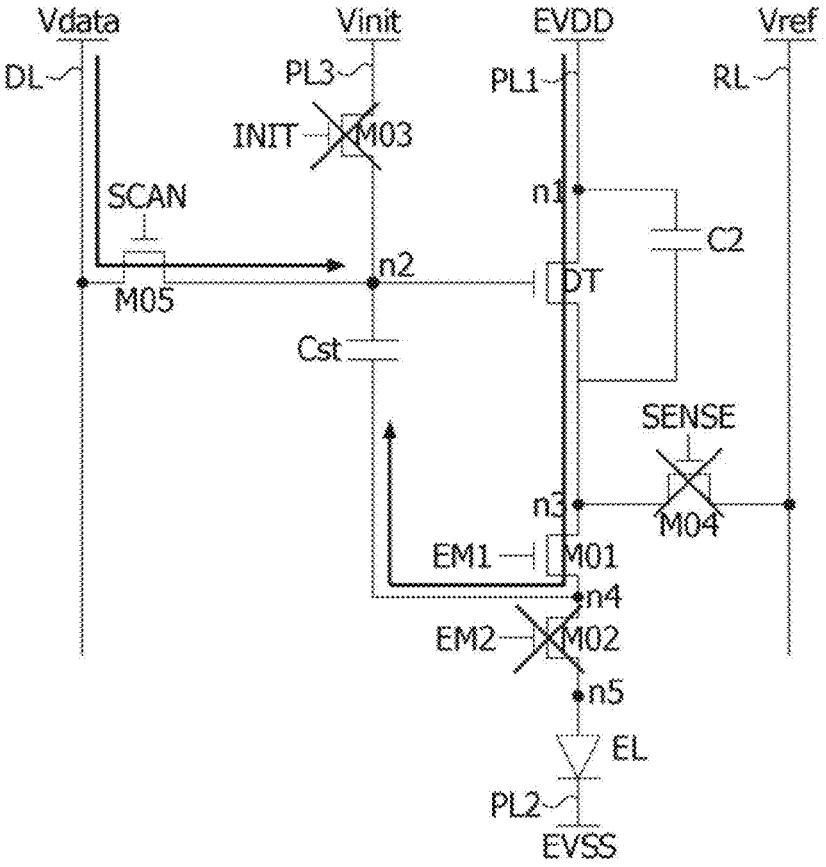

As shown in FIG. 9C, in the data writing step Tw, the third switch element M03 is turned off, and the first switch element M01 is turned on. At this time, the data voltage Vdata of the pixel data is applied to the second node n2, and thus the voltage of the second node n2 is changed by the data voltage Vdata.

Figure 9D:
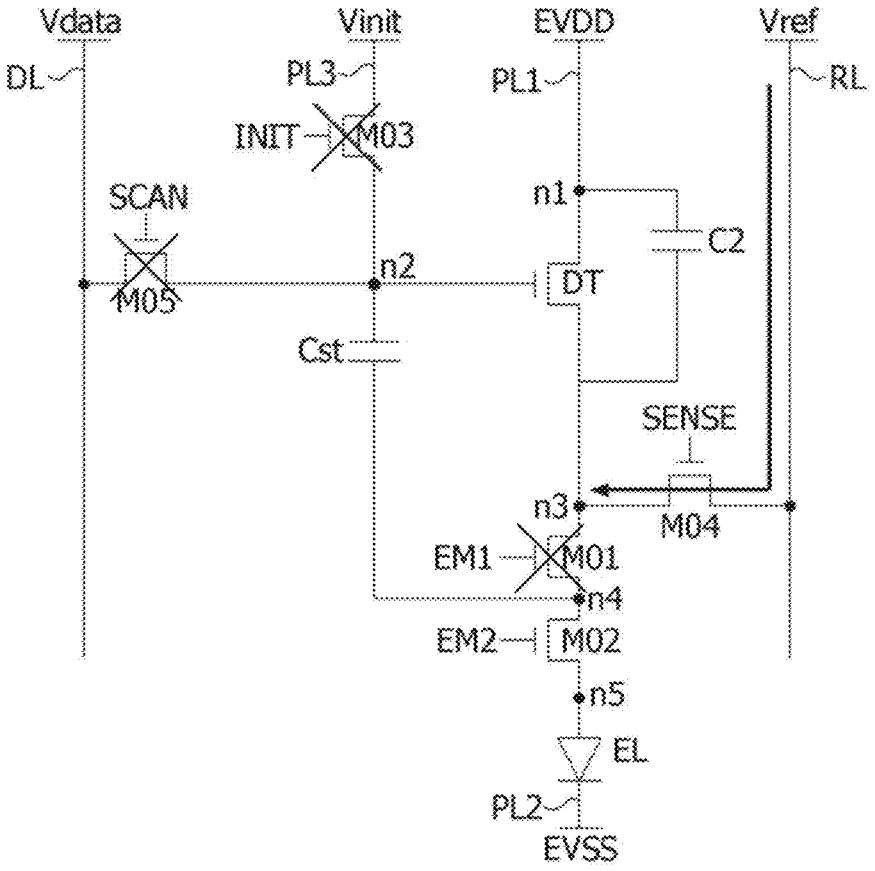

As shown in FIG. 9D, in the compensation step Tobs, the first switch element M01 is inverted to the gate-off voltage, and the fourth switch element M04 is inverted to the gate-on voltage. Also, the second switch element M02 maintains turned-on, and the third and fifth switch elements M03 and M05 maintain turned-off. At this time, the reference voltage Vref is applied to the third node n3.

For example, after the first switch element M01 is inverted to the gate-off voltage, the voltage of the second node is maintained and the reference voltage is applied to the third node. Therefore, a large Vgs voltage can be applied to the driving element, and this can reduce the influence of hysteresis of the driving element DT.

Figure 9E:
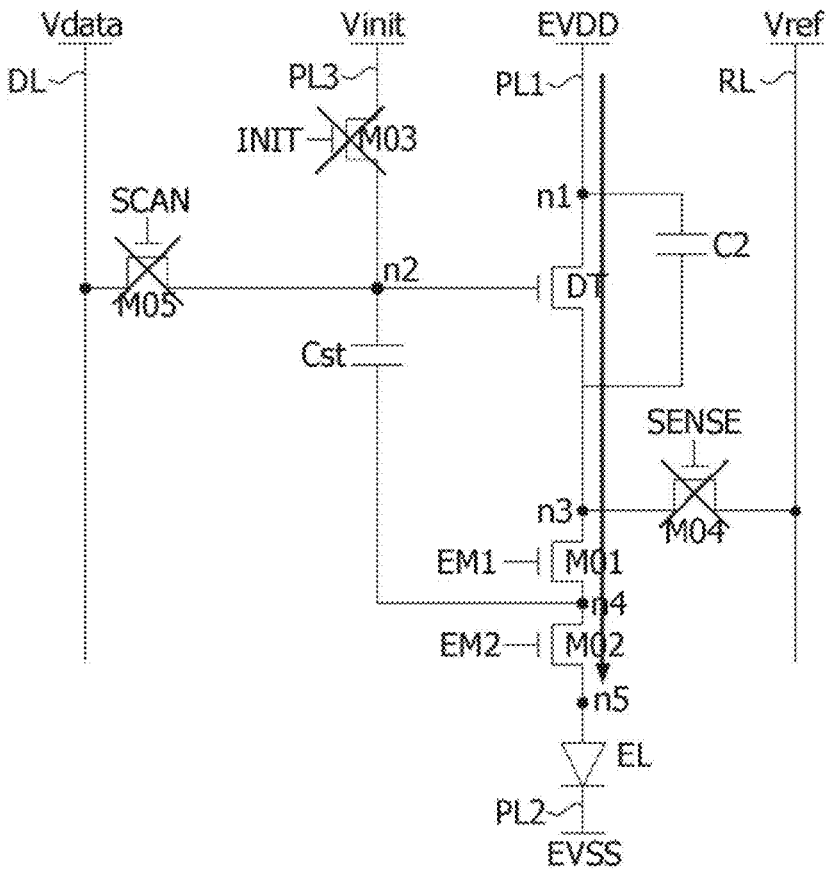

As shown in FIG. 9E, in the boosting step Tboost, the first and second switch elements M01 and M02 are turned on, and the third, fourth, and fifth switch elements M03, M04, and M05 are turned off. At this time, the voltages of the second and third nodes n2 and n3 are increased.

In the light emission step Tem after the boosting step, the first and second switch elements M01 and M02 maintain the turned-on state, and the third, fourth, and fifth switch elements M03, M04, and M05 maintain the turned-off state. At this time, a current generated according to the gate-source voltage Vgs of the driving element DT, for example, the voltage between the second and third nodes, is supplied to the light emitting element EL, so that the light emitting element EL can emit light.

In the pixel circuit according to this embodiment, when the first switch element M01 is turned off upon driving a pulse width modulation (PWM) method, the voltage of the fourth node n4 is maintained as it is, and the driving element DT is turned off while only the voltage of the second node n2 is increasing. Thus, a leakage current does not occur. On the other hand, in case that the first switch element M01 is not disposed between the third node n3 and the fourth node n4, boosting occurs at the second node n2 and the fourth node n4 upon PWM driving. Thus, the fourth node n4 rises to the high potential power voltage EVDD, and when the second switch element M02 is turned on, the voltage of the fourth node n4 drops to cause the occurrence of a leakage current.

Figure 10:
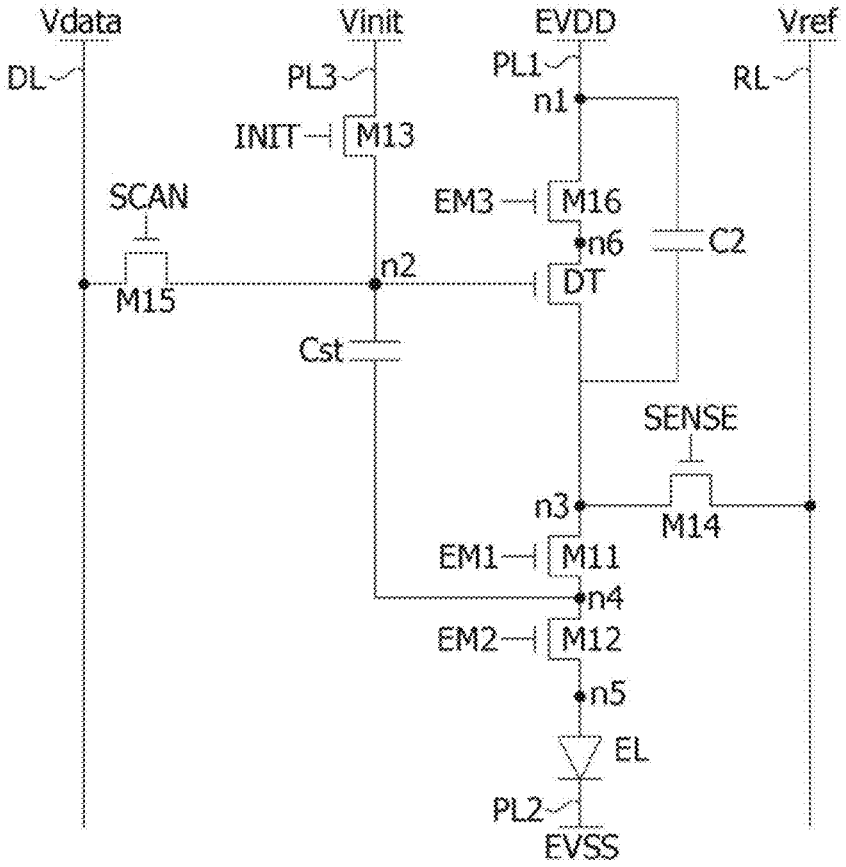
FIG. 10 is a circuit diagram illustrating a pixel circuit according to a third embodiment of the present disclosure.
Figure 11:
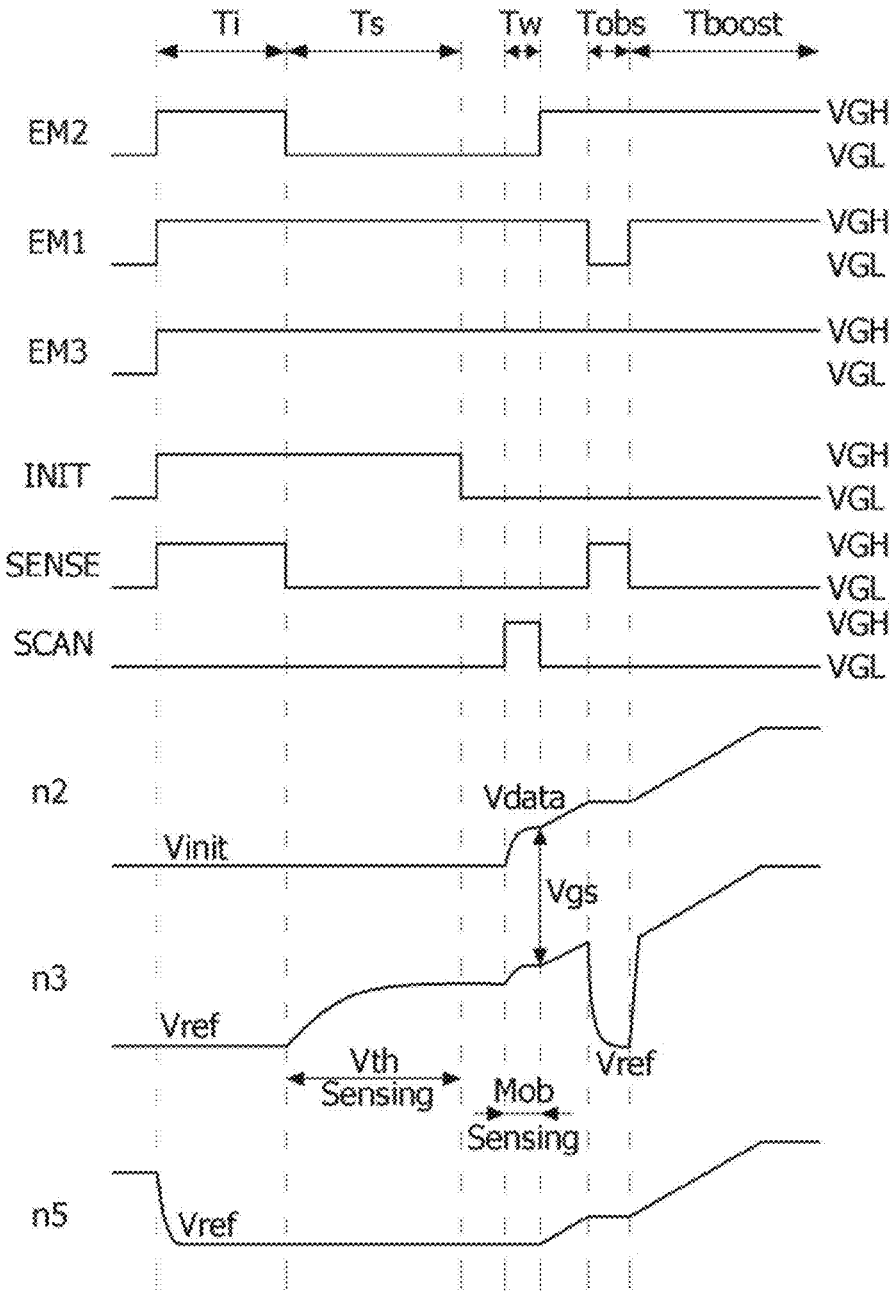
FIG. 11 is a waveform diagram illustrating a gate signal applied to the pixel circuit shown in FIG. 10.

FIG. 10 is a circuit diagram illustrating a pixel circuit according to a third embodiment of the present disclosure, and FIG. 11 is a waveform diagram illustrating a gate signal applied to the pixel circuit shown in FIG. 10.

Referring to FIGS. 10 and 11, the pixel circuit according to the third embodiment of the present disclosure includes a light emitting element EL, a driving element DT for driving the light emitting element EL, a plurality of switch elements M11, M12, M13, M14, M15, and M16, a first capacitor Cst, and a second capacitor C2. The driving element DT and the switch elements M11, M12, M13, M14, M15, and M16 can be implemented as n-channel oxide TFTs.

This pixel circuit is connected to a first power line PL1 to which a pixel driving voltage EVDD is applied, a second power line PL2 to which a low potential power voltage EVSS is applied, a third power line PL3 to which an initialization voltage Vinit is applied, a fourth power line RL to which a reference voltage Vref is applied, a data line DL to which a data voltage Vdata is applied, and gate lines to which gate signals INIT, SENSE, SCAN, EM1, EM2, and EM3 are applied.

The driving element DT generates a current according to a gate-source voltage Vgs and drives the light emitting element EL. The driving element DT includes a first electrode connected to a sixth node n6, a gate electrode connected to a second node n2, and a second electrode connected to a third node n3.

The first switch element M11 is turned on according to a gate-on voltage VEH of a first EM pulse EM1 and connects the third node n3 to a fourth node n4. The first switch element M11 includes a first electrode connected to the third node n3, a gate electrode to which the first EM pulse EM1 is applied, and a second electrode connected to the fourth node n4.

The second switch element M12 is turned on according to a gate-on voltage VEH of a second EM pulse EM2 and connects the fourth node n4 to a fifth node n5. The second switch element M12 includes a first electrode connected to the fourth node n4, a gate electrode to which the second EM pulse EM2 is applied, and a second electrode connected to the fifth node n5. Because the second switch element M12 is turned off in the sensing step Ts, even if a ripple of the low potential power voltage occurs, it is blocked by the second switch element M12, and thus the third node n3 is not affected by the low potential power voltage EVSS and the light emitting element EL.

The third switch element M13 is turned on according to a gate-on voltage VGH of an initialization pulse INIT and applies the initialization voltage Vinit to the second node n2. The third switch element M13 includes a first electrode connected to the third power line PL3 to which the initialization voltage Vinit is applied, a gate electrode to which the initialization pulse INIT is applied, and a second electrode connected to the second node n2.

The fourth switch element M14 is turned on according to a gate-on voltage VGH of a sensing pulse SENSE and connects the third node n3 to the fourth power line RL to which the reference voltage Vref is applied. The fourth switch element M14 includes a first electrode connected to the third node n3, a gate electrode to which the sensing pulse SENSE is applied, and a second electrode connected to the fourth power line RL.

The fifth switch element M15 is turned on according to a gate-on voltage VGH of a scan pulse SCAN synchronized with the data voltage Vdata and connects the data line DL to the second node n2. The fifth switch element M15 includes a first electrode connected to the data line DL to which the data voltage Vdata is applied, a gate electrode to which the scan pulse SCAN is applied, and a second electrode connected to the second node n2.

The sixth switch element M16 is turned on according to a gate-on voltage VEH of a third light emission control pulse EM3 and connects the first node n1 to the sixth node n6. The sixth switch element M16 includes a first electrode connected to the first node, a gate electrode to which the third light emission control pulse EM3 is applied, and a second electrode connected to the sixth node n6.

The first capacitor Cst is connected between the second node n2 and the fourth node n4. The second capacitor C2 is connected between the first node n1 and the third node n3.

Figure 12:
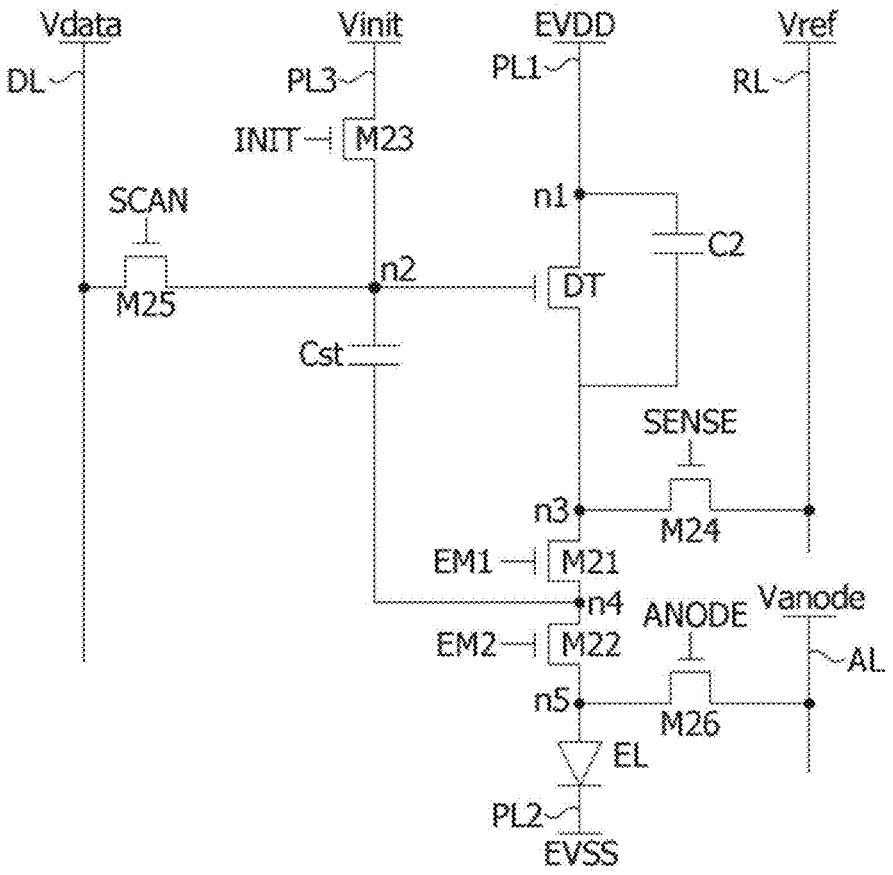
FIG. 12 is a circuit diagram illustrating a pixel circuit according to a fourth embodiment of the present disclosure.
Figure 13:
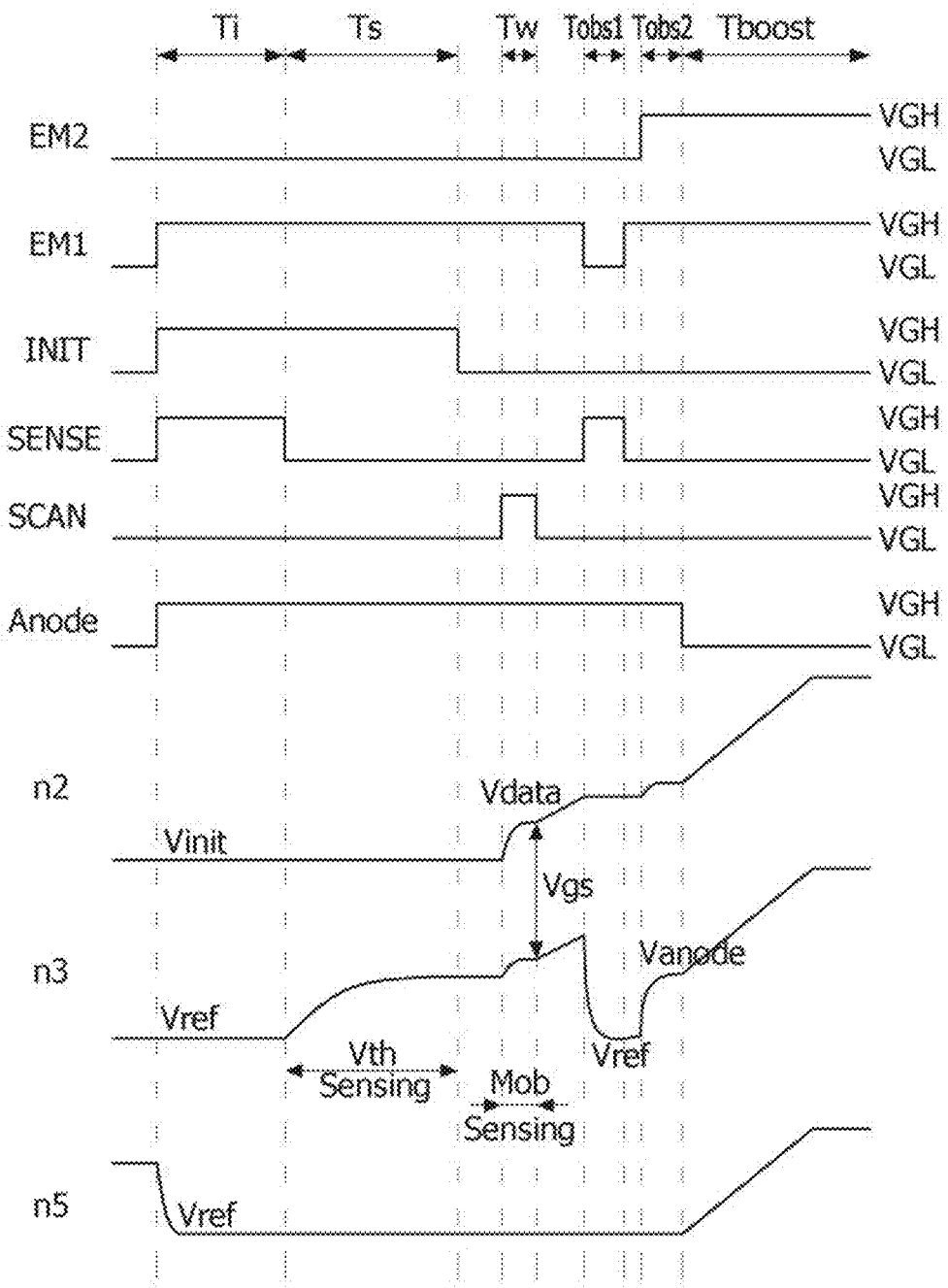
FIG. 13 is a waveform diagram illustrating a gate signal applied to the pixel circuit shown in FIG. 12.

FIG. 12 is a circuit diagram illustrating a pixel circuit according to a fourth embodiment of the present disclosure, FIG. 13 is a waveform diagram illustrating a gate signal applied to the pixel circuit shown in FIG. 12, and FIGS. 14A to 14G are circuit diagrams illustrating the operation of the pixel circuit shown in FIG. 12 in stages.

Referring to FIGS. 12 and 13, the pixel circuit according to the fourth embodiment of the present disclosure includes a light emitting element EL, a driving element DT for driving the light emitting element EL, a plurality of switch elements M21, M22, M23, M24, M25, and M26, a first capacitor Cst, and a second capacitor C2. The driving element DT and the switch elements M21, M22, M23, M24, M25, and M26 can be implemented as n-channel oxide TFTs.

This pixel circuit is connected to a first power line PL1 to which a pixel driving voltage EVDD is applied, a second power line PL2 to which a low potential power voltage EVSS is applied, a third power line PL3 to which an initialization voltage Vinit is applied, a fourth power line RL to which a reference voltage Vref is applied, a data line DL to which a data voltage Vdata is applied, and gate lines to which gate signals INIT, SENSE, SCAN, EM1, and EM2 are applied. In addition, the pixel circuit is connected to a fifth power line AL to which an anode voltage Vanode is applied.

The driving element DT generates a current according to a gate-source voltage Vgs and drives the light emitting element EL. The driving element DT includes a first electrode connected to a first node n1, a gate electrode connected to a second node n2, and a second electrode connected to a third node n3.

The first switch element M21 is turned on according to a gate-on voltage VEH of a first light emission control pulse EM1 and connects the third node n3 to a fourth node n4. The first switch element M21 includes a first electrode connected to the third node n3, a gate electrode to which the first light emission control pulse EM1 is applied, and a second electrode connected to the fourth node n4.

The second switch element M22 is turned on according to a gate-on voltage VEH of a second light emission control pulse EM2 and connects the fourth node n4 to a fifth node n5. The second switch element M22 includes a first electrode connected to the fourth node n4, a gate electrode to which the second light emission control pulse EM2 is applied, and a second electrode connected to the fifth node n5.

The third switch element M23 is turned on according to a gate-on voltage VGH of an initialization pulse INIT and applies the initialization voltage Vinit to the second node n2. The third switch element M23 includes a first electrode connected to the third power line PL3 to which the initialization voltage Vinit is applied, a gate electrode to which the initialization pulse INIT is applied, and a second electrode connected to the second node n2.

The fourth switch element M24 is turned on according to a gate-on voltage VGH of a sensing pulse SENSE and supplies the reference voltage Vref to the third node n3. The fourth switch element M24 includes a first electrode connected to the third node n3, a gate electrode to which the sensing pulse SENSE is applied, and a second electrode connected to the fourth power line RL.

The fifth switch element M25 is turned on according to a gate-on voltage VGH of a scan pulse SCAN and connects the data line DL to the second node n2. The fifth switch element M25 includes a first electrode connected to the data line DL to which the data voltage Vdata is applied, a gate electrode to which the scan pulse SCAN is applied, and a second electrode connected to the second node n2.

The sixth switch element M26 is turned on according to a gate-on voltage VGH of an anode pulse ANODE and applies the anode voltage Vanode to the fifth node n5. The sixth switch element M26 includes a first electrode connected to the fifth node n5, a gate electrode to which the anode pulse ANODE is applied, and a second electrode connected to the fifth power line AL to which the anode voltage Vanode is applied.

The first capacitor Cst is connected between the second node n2 and the fourth node n4. The second capacitor C2 is connected between the first node n1 and the third node n3.

Figure 14A:
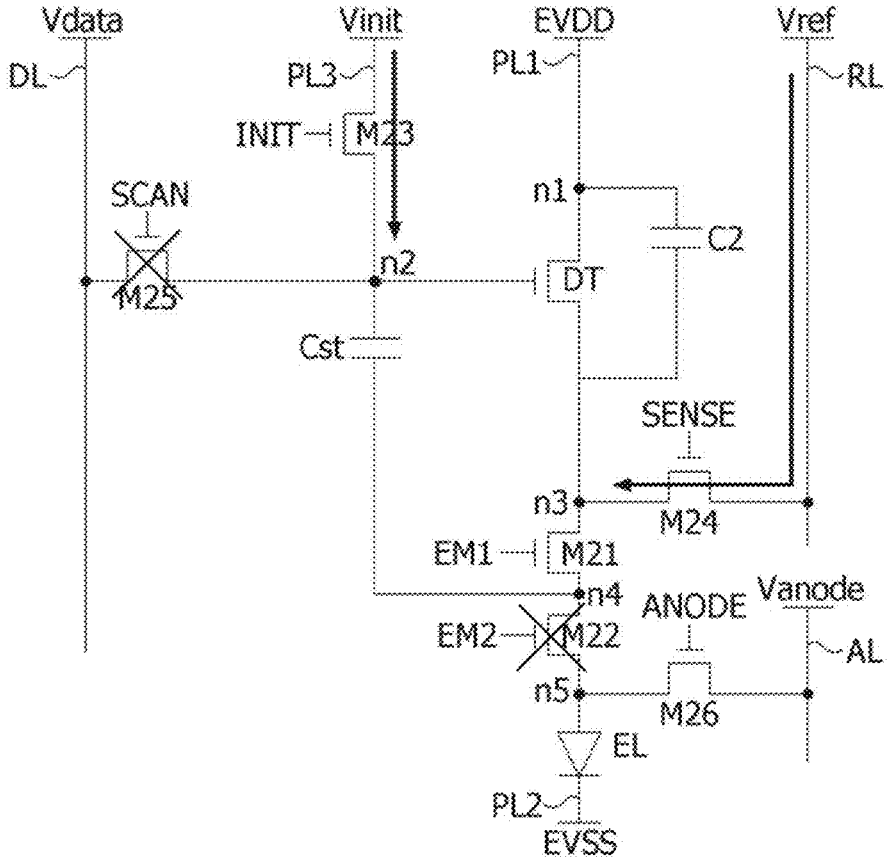
FIGS. 14A to 14G are circuit diagrams illustrating the operation of the pixel circuit shown in FIG. 12 in stages.

Referring to FIG. 14A, in the initialization step Ti, the first, third, fourth and sixth switch elements M21, M23, M24 and M26, and the driving element DT are turned on, whereas the second and fifth switch elements M22 and M25 are turned off. At this time, the initialization voltage Vinit is applied to the second node n2, and the reference voltage Vref is applied to the third node n3. At the same time, the pixel driving voltage EVDD is applied to the first node n1, and the initialization voltage Vinit or the anode voltage Vanode is applied to the fourth node n4.

Figure 14B:
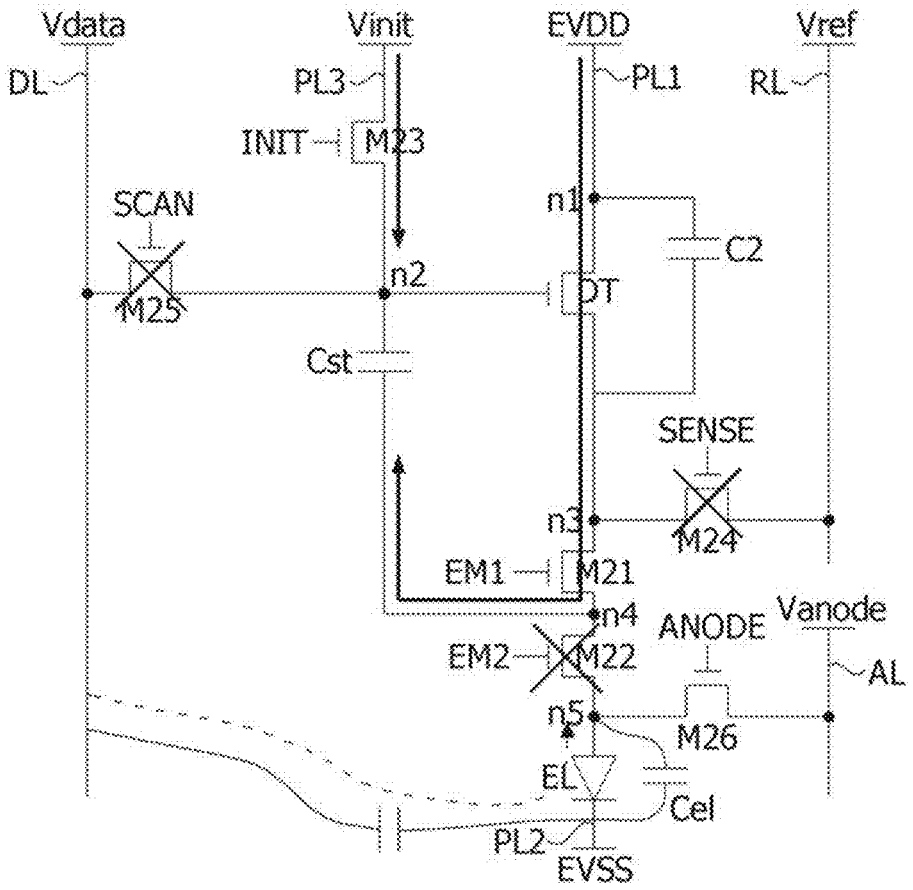

Referring to FIG. 14B, in the sensing step Ts, the first, third and sixth switch elements M21, M23 and M26 maintain the turned-on state, and the fifth switch element M25 maintains the turned-off state. The sensing pulse SENSE is inverted to the gate-off voltage VGL, and the second and fourth switch elements M22 and M24 are turned off. The driving element DT is turned off when the voltage of the third node n3 rises and the gate-source voltage Vgs reaches the threshold voltage Vth, and the threshold voltage Vth is stored in the first capacitor Cst. Because the second switch element M22 is turned off in the sensing step Ts, even if a ripple of the low potential power voltage occurs, it is blocked by the second switch element M22, and the third node n3 is not affected by the low potential power voltage EVSS and the light emitting element EL.

Figure 14C:
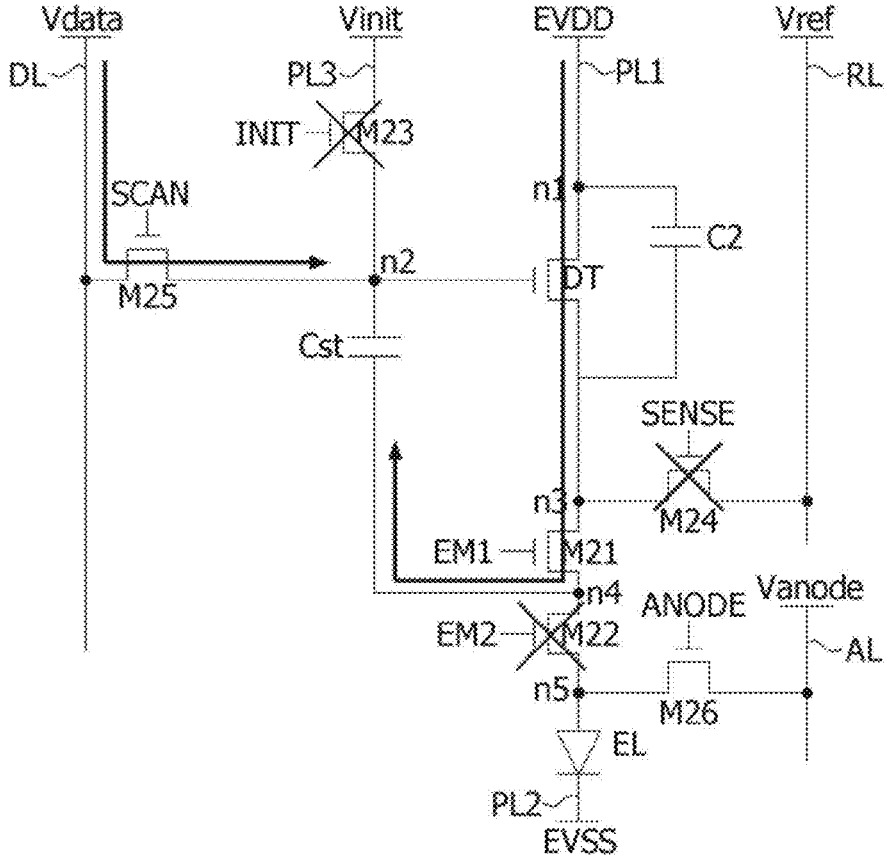

Referring to FIG. 14C, in the data writing step Tw, the first, fifth and sixth switch elements M21, M25 and M26 are turned on, whereas the second, third and fourth switch elements M22, M23 and M24 are turned off. The driving element DT can be turned on when the voltage of the second node n2 is increased to the data voltage Vdata and thereby the gate-source voltage Vgs becomes higher than the threshold voltage Vth.

Figure 14D:
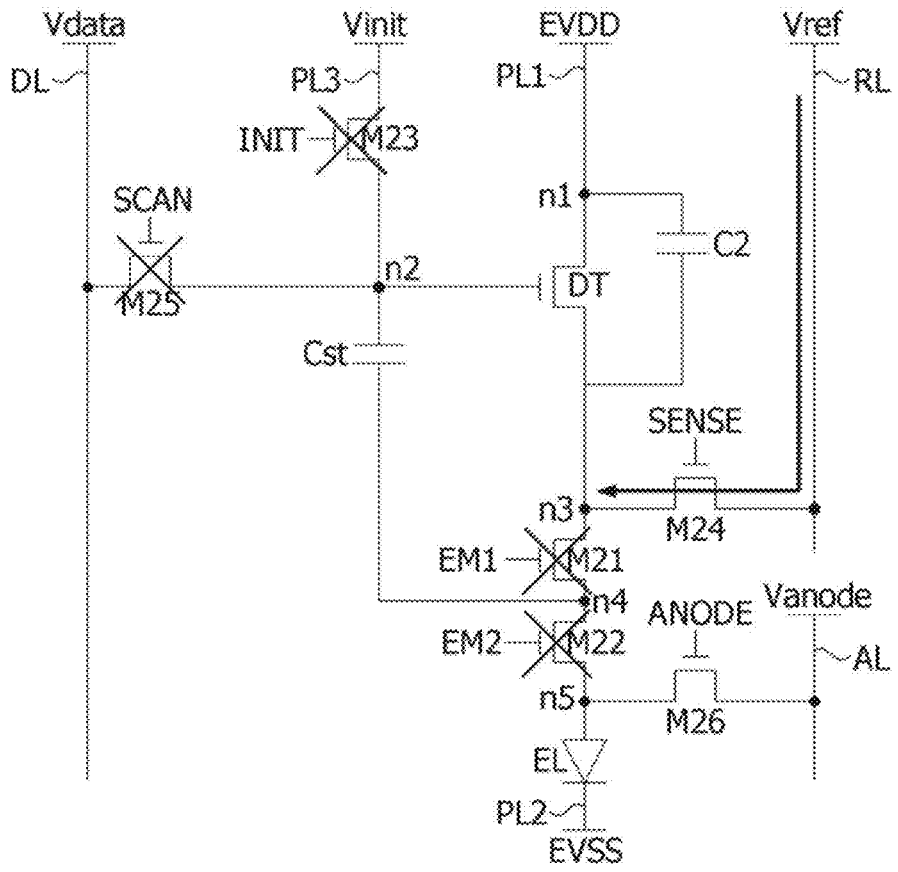

Referring to FIG. 14D, in a first compensation step Tobs1, the first, second, third and fifth switch elements M21, M22, M23 and M25 are turned off, whereas the fourth and sixth switch elements M24 and M26 are turned on. At this time, the reference voltage Vref is applied to the third node n3. Through this compensation step, it is possible to remove the influence of the hysteresis of the driving element DT by using the voltage of the source node of the driving element as a reference voltage before the boosting step.

Figure 14E:
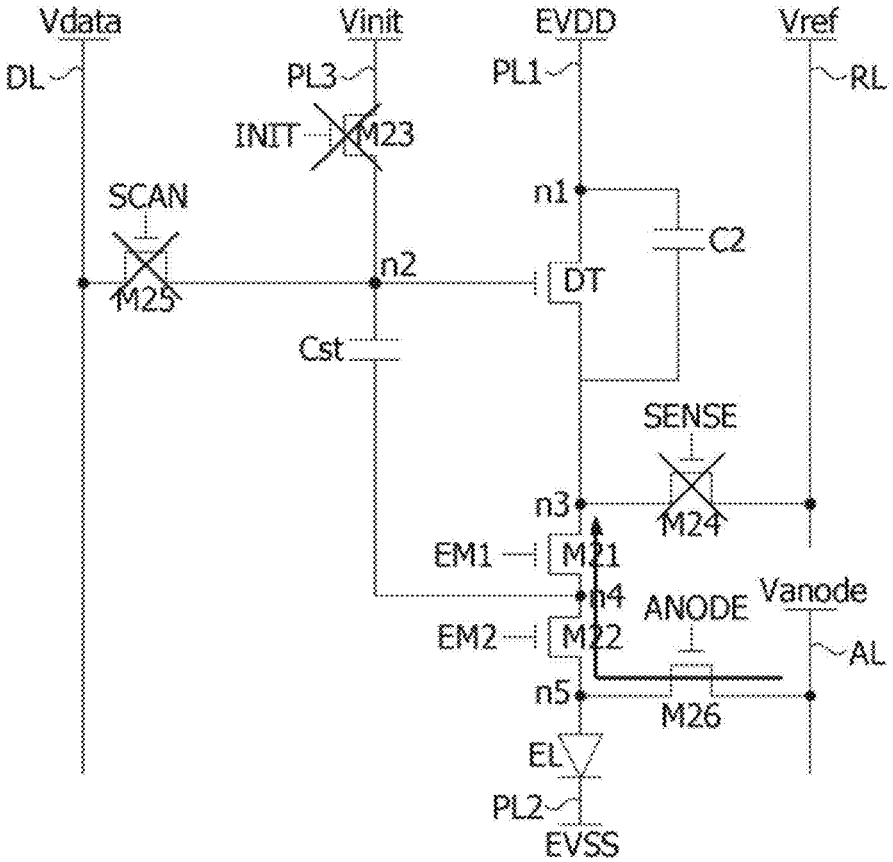

Referring to FIG. 14E, in a second compensation step Tobs2, the first, second and sixth switch elements M21, M22 and M26 are turned on, whereas the third, fourth and fifth switch elements M23, M24 and M25 are turned off. At this time, the anode voltage is applied to the fifth node n5, and all of the third node n3, the fourth node n4, and the fifth node n5 are increased to the anode voltage.

Figure 14F:
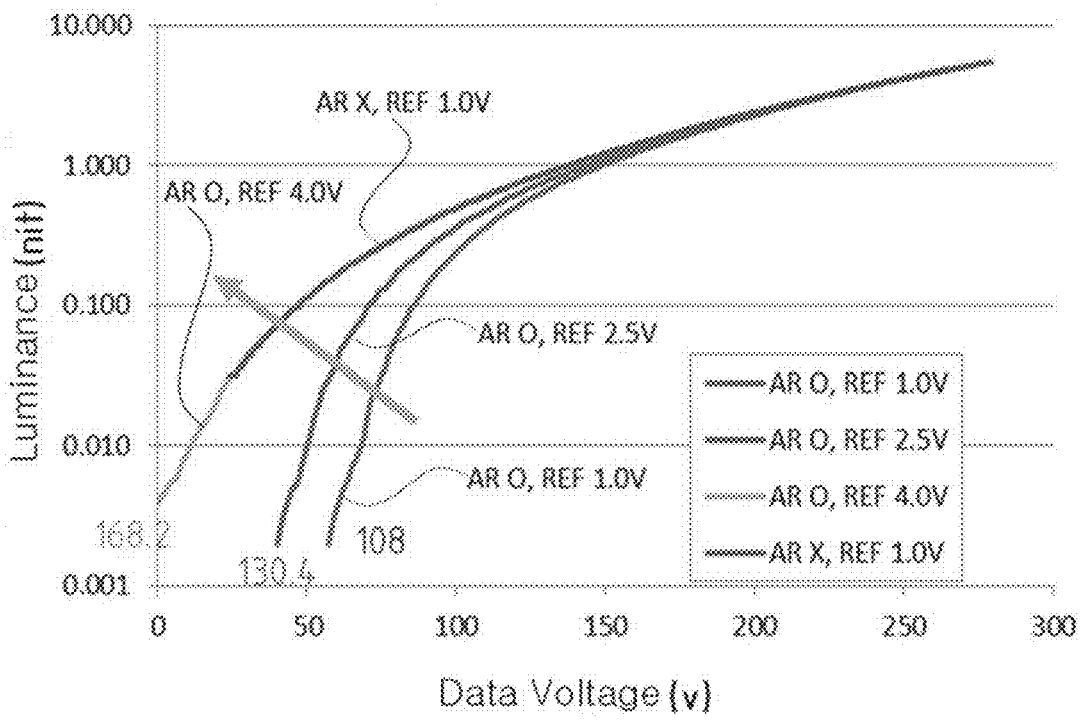

In the embodiment, it is intended that the S-factor is alleviated by separating the reference voltage and the anode voltage and initializing the source node of the driving element with a relatively high anode voltage rather than the reference voltage in the second compensation step before the boosting step. As shown in FIG. 14F, it can be seen that a change in the luminance according to the data voltage is gradually alleviated in the low gray scale region when the reference voltage is increased.

Figure 14G:
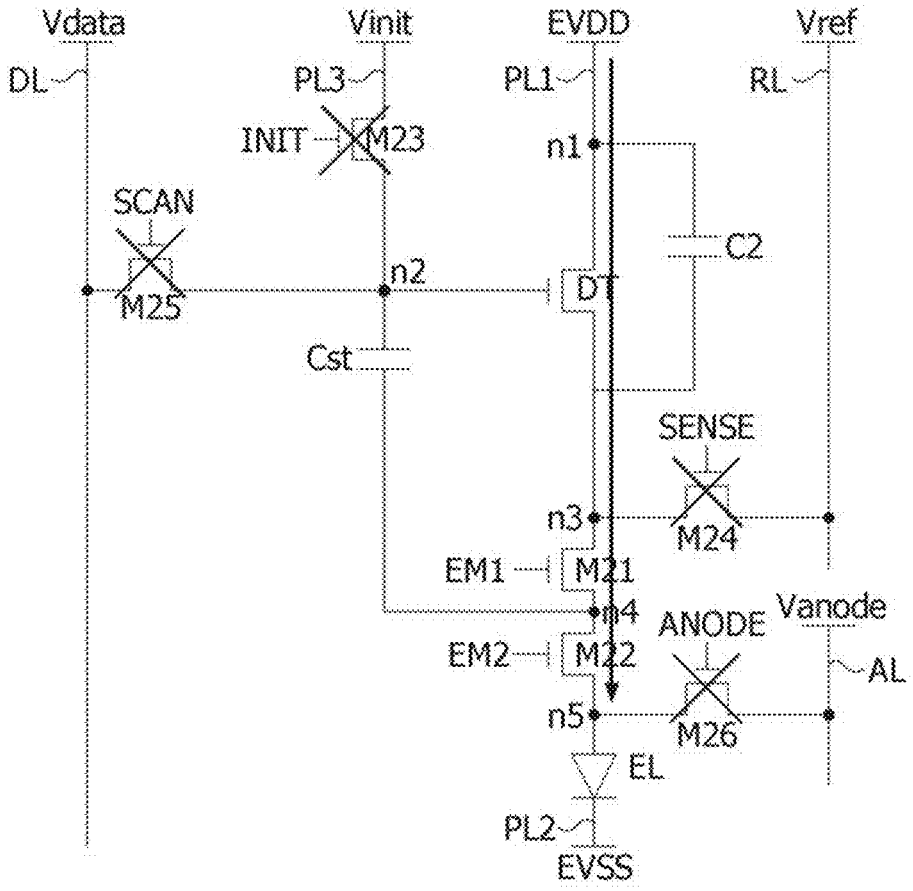

Referring to FIG. 14G, in the boosting step Tboost, the first and second switch elements M21 and M22 are turned on, whereas the other switch elements M23, M24, M25 and M26 are turned off. During the boosting step Tboost, the voltages of the second and third nodes n2 and n3 are increased.

Thereafter, in the light emission step Tem, the pixel circuit operates as a source follower circuit, and a current is supplied to the light emitting element EL according to the gate-source voltage Vgs of the driving element DT. At this time, the light emitting element EL can emit light with a luminance corresponding to the gray scale of the pixel data.

In order to improve low gray scale expression in the light emission step Tem, the first and second light emission control pulses EM1 and EM2 can swing between the gate-on voltage VEH and the gate-off voltage VEL. In the light emission step Tem, the first and second light emission control pulses EM1 and EM2 can swing at a duty ratio which is set with predetermined pulse width modulation (PWM).

Figure 15:
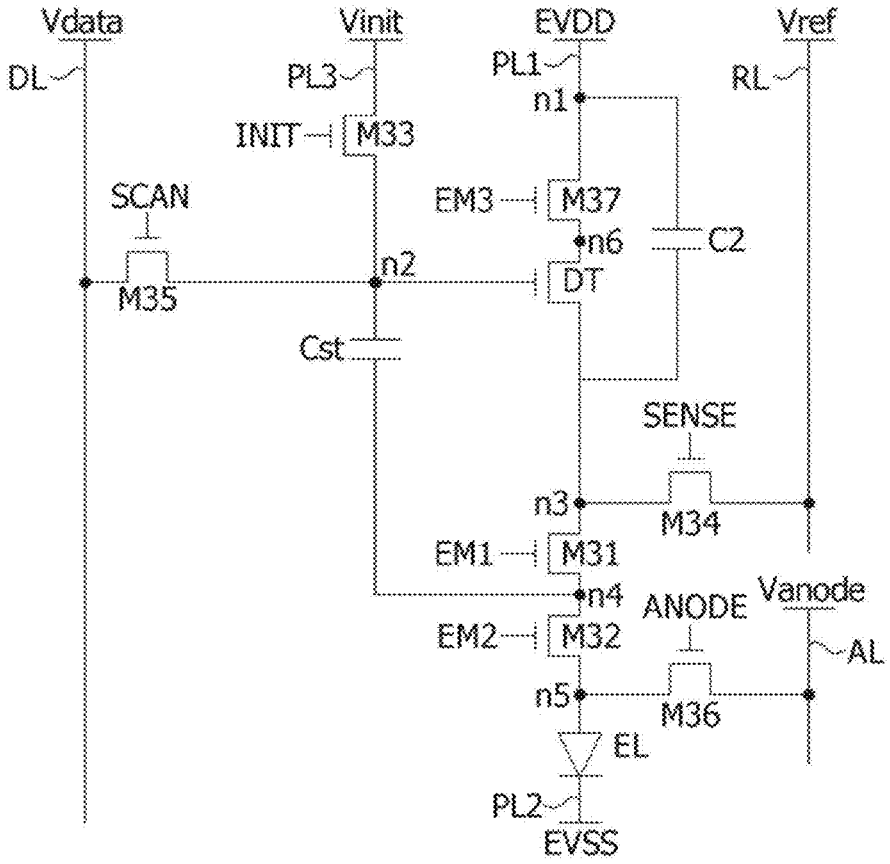
FIG. 15 is a circuit diagram illustrating a pixel circuit according to a fifth embodiment of the present disclosure.
Figure 16:
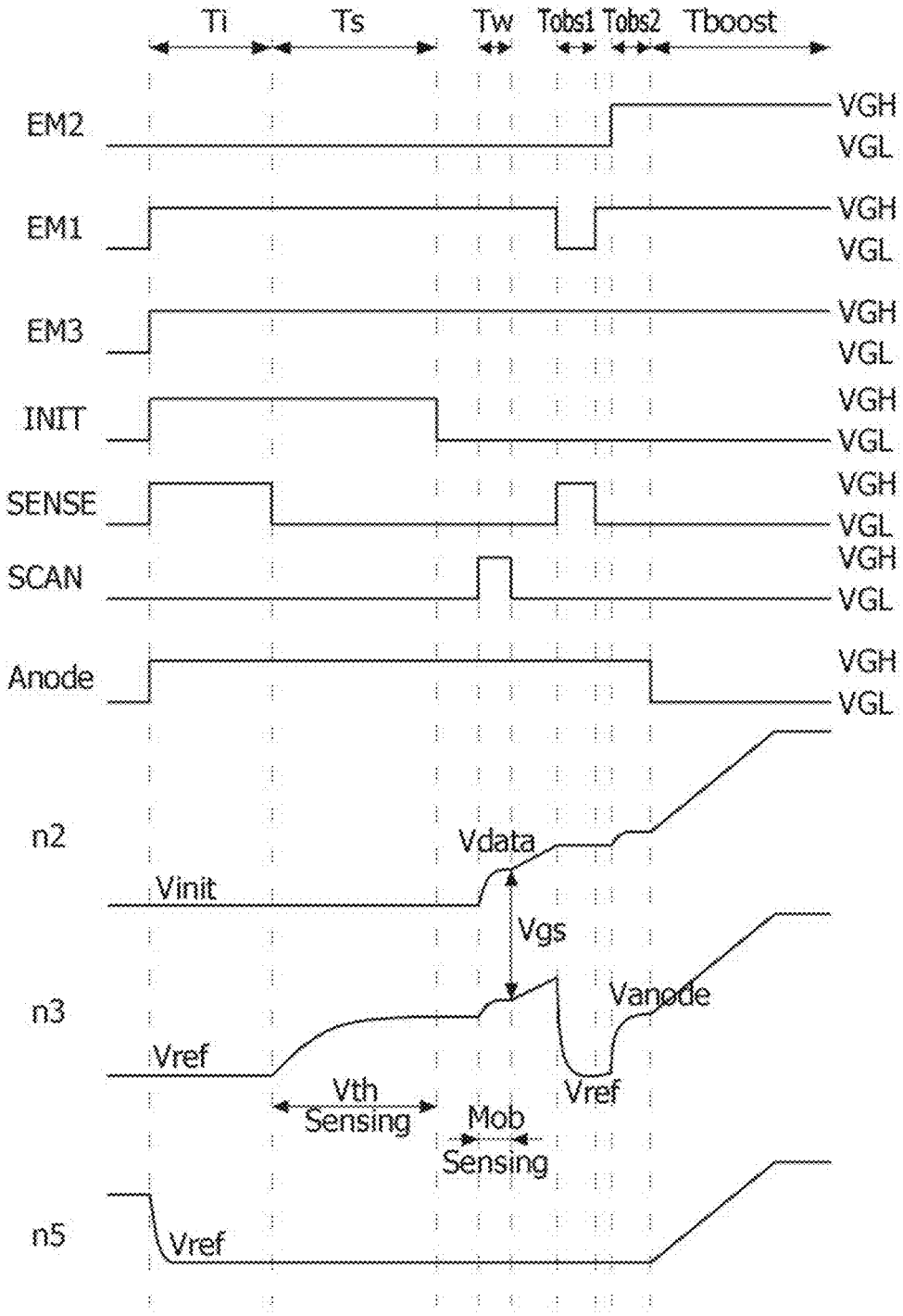
FIG. 16 is a waveform diagram illustrating a gate signal applied to the pixel circuit shown in FIG. 15.

FIG. 15 is a circuit diagram illustrating a pixel circuit according to a fifth embodiment of the present disclosure, and FIG. 16 is a waveform diagram illustrating a gate signal applied to the pixel circuit shown in FIG. 15.

Referring to FIGS. 15 and 16, the pixel circuit according to the fifth embodiment of the present disclosure includes a light emitting element EL, a driving element DT for driving the light emitting element EL, a plurality of switch elements M31, M32, M33, M34, M35, M36, and M37, a first capacitor Cst, and a second capacitor C2. The driving element DT and the switch elements M31, M32, M33, M34, M35, M36, and M37 can be implemented as n-channel oxide TFTs.

The driving element DT generates a current according to a gate-source voltage Vgs and drives the light emitting element EL. The driving element DT includes a first electrode connected to a first node n1, a gate electrode connected to a second node n2, and a second electrode connected to a third node n3.

The first switch element M31 is turned on according to a gate-on voltage VEH of a first light emission control pulse EM1 and connects the third node n3 to a fourth node n4. The first switch element M31 includes a first electrode connected to the third node n3, a gate electrode to which the first light emission control pulse EM1 is applied, and a second electrode connected to the fourth node n4.

The second switch element M32 is turned on according to a gate-on voltage VEH of a second light emission control pulse EM2 and connects the fourth node n4 to a fifth node n5. The second switch element M32 includes a first electrode connected to the fourth node n4, a gate electrode to which the second light emission control pulse EM2 is applied, and a second electrode connected to the fifth node n5.

The third switch element M33 is turned on according to a gate-on voltage VGH of an initialization pulse INIT and applies the initialization voltage Vinit to the second node n2. The third switch element M33 includes a first electrode connected to the third power line PL3 to which the initialization voltage Vinit is applied, a gate electrode to which the initialization pulse INIT is applied, and a second electrode connected to the second node n2.

The fourth switch element M34 is turned on according to a gate-on voltage VGH of a sensing pulse SENSE and supplies the reference voltage Vref to the third node n3. The fourth switch element M34 includes a first electrode connected to the third node n3, a gate electrode to which the sensing pulse SENSE is applied, and a second electrode connected to the fourth power line RL.

The fifth switch element M35 is turned on according to a gate-on voltage VGH of a scan pulse SCAN and connects the data line DL to the second node n2. The fifth switch element M35 includes a first electrode connected to the data line DL to which the data voltage Vdata is applied, a gate electrode to which the scan pulse SCAN is applied, and a second electrode connected to the second node n2.

The sixth switch element M36 is turned on according to a gate-on voltage VGH of an anode pulse ANODE and applies the anode voltage Vanode to the fifth node n5. The sixth switch element M36 includes a first electrode connected to the fifth node n5, a gate electrode to which the anode pulse ANODE is applied, and a second electrode connected to the fifth power line AL to which the anode voltage Vanode is applied.

The seventh switch element M37 is turned on according to a gate-on voltage VEH of a third light emission control pulse EM3 and connects the first node n1 to a sixth node n6. The seventh switch element M37 includes a first electrode connected to the first node, a gate electrode to which the third emission control pulse EM3 is applied, and a second electrode connected to the sixth node.

The first capacitor Cst is connected between the second node n2 and the fourth node n4. The second capacitor C2 is connected between the first node n1 and the third node n3.

Although the embodiments of the present disclosure have been described in more detail with reference to the accompanying drawings, the present disclosure is not limited thereto and can be embodied in many different forms without departing from the technical concept of the present disclosure. Therefore, the embodiments disclosed in the present disclosure are provided for illustrative purposes only and are not intended to limit the technical concept of the present disclosure. The scope of the technical concept of the present disclosure is not limited thereto.

Therefore, it should be understood that the above-described embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A pixel circuit comprising:

a driving element including a first electrode connected to a first node to which a pixel driving voltage is applied, a gate electrode connected to a second node, and a second electrode connected to a third node;

a first switch element including a first electrode connected to the third node, a gate electrode to which a first light emission control pulse is applied, and a second electrode connected to a fourth node;

a second switch element including a first electrode connected to the fourth node, a gate electrode to which a second light emission control pulse is applied, and a second electrode connected to a fifth node;

a light emitting device including an anode connected to the fifth node, and a cathode electrode to which a low potential power voltage is applied;

a first capacitor connected between the second node and the fourth node; and a second capacitor connected between the first node and the third node.

2. The pixel circuit of claim 1, further comprising:

a third switch element including a first electrode to which an initialization voltage is applied, a gate electrode to which an initialization pulse is applied, and a second electrode connected to the second node;

a fourth switch element including a first electrode connected to the third node, a gate electrode to which a sensing pulse is applied, and a second electrode to which a reference voltage is applied; and a fifth switch element including a first electrode to which a data voltage is applied, a gate electrode to which a scan pulse is applied, and a second electrode connected to the second node.

3. The pixel circuit of claim 2, wherein the pixel circuit is driven in the order of an initialization step, a sensing step, a data writing step, and a boosting step, in the initialization step, voltages of the first light emission control pulse, the second light emission control pulse, the initialization pulse, and the sensing pulse are gate-on voltages, and a voltage of the scan pulse is a gate-off voltage, in the sensing step, voltages of the first light emission control pulse and the initialization pulse are gate-on voltages, and voltages of the second light emission control pulse, the sensing pulse, and the scan pulse are gate-off voltages, in the data writing step, voltages of the first light emission control pulse and the scan pulse are gate-on voltages, and voltages of the second light emission control pulses, the initialization pulse, and the sensing pulse are gate-off voltages, in the boosting step, voltages of the first light emission control pulse and the second light emission control pulse are gate-on voltages, and voltages of the initialization pulse, the sensing pulse, and the scan pulse are gate-off voltages, and the first to fifth switch elements are selectively turned on according to the gate-on voltages and turned off according to the gate-off voltages.

4. The pixel circuit of claim 3, wherein a compensation step is allocated between the data writing step and the boosting step, in the compensation step, a voltage of the first light emission control pulse is inverted to a gate-off voltage, and a voltage of the sensing pulse is inverted to a gate-on voltage, a voltage of the second light emission control pulse is maintained as the gate-on voltage, and each of voltages of the initialization pulse and the scan pulse is maintained as the gate-off voltage.

5. The pixel circuit of claim 2, further comprising:

a sixth switch element connected between the first node and the first electrode of the driving element, and connecting the first node and the first electrode of the driving element in response to a third light emission control pulse being the gate-on voltage.

6. The pixel circuit of claim 2, further comprising:

a sixth switch element including a first electrode connected to the fifth node, a gate electrode to which an anode pulse is applied, and a second electrode to which an anode voltage is applied.

7. The pixel circuit of claim 6, wherein the pixel circuit is driven in the order of an initialization step, a sensing step, a data writing step, and a boosting step, in the initialization step, voltages of the first light emission control pulse, the initialization pulse, the sensing pulse, and the anode pulse are gate-on voltages, and voltages of the second light emission control pulse and the scan pulse are gate-off voltages, in the sensing step, voltages of the first light emission control pulse, the initialization pulse, and the anode pulse are gate-on voltages, and voltages of the second light emission control pulse, the sensing pulse, and the scan pulse are gate-off voltages, in the data writing step, voltages of the first light emission control pulse, the scan pulse, and the anode pulse are gate-on voltages, and voltages of the second light emission control pulses, the initialization pulse, and the sensing pulse are gate-off voltages, in the boosting step, voltages of the first light emission control pulse and the second light emission control pulse are gate-on voltages, and voltages of the initialization pulse, the sensing pulse, the scan pulse, and the anode pulse are gate-off voltages, and the first to sixth switch elements are selectively turned on according to the gate-on voltages and turned off according to the gate-off voltages.

8. The pixel circuit of claim 7, wherein a first compensation step and a second compensation step are allocated between the data writing step and the boosting step, in the first compensation step, the first light emission control pulse is inverted to a gate-off voltage, the sensing pulse is inverted to a gate-on voltage, a voltage of the anode pulse is maintained as the gate-on voltage, and voltages of the second light emission control pulse, the initialization pulse, and the scan pulse are maintained as the gate-off voltages, and in the second compensation step, voltages of the first light emission control pulse and the second light emission control pulse are inverted to gate-on voltages, a voltage of the sensing pulse is inverted to a gate-off voltage, a voltage of the anode pulse is maintained as the gate-on voltage, and voltages of the initialization pulse and the scan pulse are maintained as the gate-off voltages.

9. The pixel circuit of claim 6, further comprising:

a seventh switch element connected between the first node and the first electrode of the driving element, and connecting the first node and the first electrode of the driving element in response to a third light emission control pulse being the gate-on voltage.

10. The pixel circuit of claim 6, wherein the anode voltage is higher than the reference voltage.

11. A display device comprising:

a display panel in which a plurality of data lines, a plurality of gate lines intersecting with the data lines, a plurality of power lines to which different constant voltages are applied, and a plurality of sub-pixels are disposed;

a data driver configured to supply a data voltage of pixel data to the data lines; and a gate driver configured to supply a gate signal to the gate lines, each of the sub-pixels comprising:

a driving element including a first electrode connected to a first node to which a pixel driving voltage is applied, a gate electrode connected to a second node, and a second electrode connected to a third node;

a first switch element including a first electrode connected to the third node, a gate electrode to which a first light emission control pulse is applied, and a second electrode connected to a fourth node;

a second switch element including a first electrode connected to the fourth node, a gate electrode to which a second light emission control pulse is applied, and a second electrode connected to a fifth node;

a light emitting device including an anode connected to the fifth node, and a cathode electrode to which a low potential power voltage is applied;

a first capacitor connected between the second node and the fourth node; and a second capacitor connected between the first node and the third node.

12. The display device of claim 11, wherein each of the sub-pixels further comprises:

a third switch element including a first electrode to which an initialization voltage is applied, a gate electrode to which an initialization pulse is applied, and a second electrode connected to the second node;

a fourth switch element including a first electrode connected to the third node, a gate electrode to which a sensing pulse is applied, and a second electrode to which a reference voltage is applied; and a fifth switch element including a first electrode to which a data voltage is applied, a gate electrode to which a scan pulse is applied, and a second electrode connected to the second node.

13. The display device of claim 12, wherein each of the sub-pixels further comprises:

a sixth switch element connected between the first node and the first electrode of the driving element, and connecting the first node and the first electrode of the driving element in response to a third light emission control pulse being the gate-on voltage.

14. The display device of claim 12, wherein each of the sub-pixels further comprises:

a sixth switch element including a first electrode connected to the fifth node, a gate electrode to which an anode pulse is applied, and a second electrode to which an anode voltage is applied.

15. The display device of claim 14, wherein each of the sub-pixels further comprises:

a seventh switch element connected between the first node and the first electrode of the driving element, and connecting the first node and the first electrode of the driving element in response to a third light emission control pulse being the gate-on voltage.

16. The display device of claim 11, wherein all transistors in a panel including the data driver, the gate driver, and the sub-pixels are implemented with oxide thin film transistors (TFTs) including an n-channel type oxide semiconductor.

17. The display device of claim 14, wherein the anode voltage is higher than the reference voltage.

* * * * *